US007537305B2

(12) United States Patent
Chiwata

(10) Patent No.: US 7,537,305 B2
(45) **Date of Patent: *May 26, 2009**

(54) IMAGE RECORDING APPARATUS AND IMAGE RECORDING METHOD

(75) Inventor: Yuhei Chiwata, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 205 days.

This patent is subject to a terminal disclaimer.

(21) Appl. No.: 11/637,701

(22) Filed: Dec. 13, 2006

(65) Prior Publication Data

US 2007/0132804 A1 Jun. 14, 2007

(30) Foreign Application Priority Data

Dec. 14, 2005 (JP) ..... 2005-360962

(51) Int. Cl.
*B41J 29/393* (2006.01)

(52) U.S. Cl. ..... 347/19

(58) Field of Classification Search ..... 347/5, 347/9, 10, 11, 12, 15, 19
See application file for complete search history.

(56) References Cited

U.S. PATENT DOCUMENTS

| | | | |
|---|---|---|---|
| 5,276,459 | A | 1/1994 | Danzuka et al. |
| 5,528,270 | A | 6/1996 | Tajika et al. |
| 5,946,006 | A | 8/1999 | Tajika et al. |
| 2002/0140754 | A1 | 10/2002 | Someno |
| 2004/0022570 | A1 | 2/2004 | Ioka et al. |
| 2004/0104951 | A1 | 6/2004 | Shibata et al. |

FOREIGN PATENT DOCUMENTS

| | | | |
|---|---|---|---|
| EP | 1 463 296 | A2 | 9/2004 |
| JP | 4-18363 | A | 1/1992 |
| JP | 5-69545 | A | 3/1993 |
| JP | 2004-50430 | A | 2/2004 |
| JP | 2004-58282 | A | 2/2004 |

*Primary Examiner*—Lamson D. Nguyen
(74) *Attorney, Agent, or Firm*—Birch, Stewart, Kolasch & Birch

(57) ABSTRACT

The image recording apparatus includes: a recording head which has a plurality of recording elements; a conveyance device which causes the recording head and a recording medium to move relatively to each other by conveying at least one of the recording head and the recording medium; a characteristic information acquisition device which acquires information that indicates recording characteristics of the recording elements, the recording characteristics including recording position errors of the recording elements and errors in volume of droplets ejected from the recording elements; a correction range setting device which sets N correction recording elements (where N is an integer larger than 1) for use in correction of output density, from among the plurality of recording elements; a correction coefficient specification device which specifies density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero; a correction processing device which performs calculation for correcting the output density by using the density correction coefficients specified by the correction coefficient specification device; and a drive control device which controls driving of the recording elements according to correction results produced by the correction processing device.

10 Claims, 16 Drawing Sheets

FIG.4

| CASE | NZ2 | NZ3 | NZ4 | ACTION |
|---|---|---|---|---|
| NO EJECTION FAILURE IN ANY NOZZLE | good | good | good | CORRECTION COEFFICIENT GENERATION METHOD A |
| ONE EJECTION FAILURE NOZZLE; CORRECTION OBJECT NOZZLE SUFFERING EJECTION FAILURE | good | poor | good | CORRECTION COEFFICIENT GENERATION METHOD B |
| ONE EJECTION FAILURE NOZZLE; NOZZLE OTHER THAN CORRECTION OBJECT NOZZLE, SUFFERING EJECTION FAILURE | poor | good | good | CORRECTION COEFFICIENT GENERATION METHOD C |
| | good | good | poor | |
| TWO OR MORE NOZZLES SUFFERING EJECTION FAILURE | poor | poor | good | HEAD CLEANING (JUDGED THAT CORRECTION IS NOT POSSIBLE) |
| | good | poor | poor | |
| | poor | good | poor | |
| | poor | poor | poor | |

IMAGE RECORDING APPARATUS AND IMAGE RECORDING METHOD

BACKGROUND OF THE INVENTION

1. Field of the Invention

The present invention relates to an image recording apparatus and an image recording method, and more particularly to image processing technology which is suitable for correcting density non-uniformities caused by variation in characteristics between recording elements of a recording head.

2. Description of the Related Art

In an image recording apparatus (inkjet printer) having an inkjet type of recording head comprising a plurality of ink ejection ports (nozzles), problems of image quality arise due to the occurrence of density variations (density non-uniformities) in the recorded image caused by variations in the ejection characteristics of the nozzles. The variations in the ejection characteristics of the nozzles causing the density variations include: depositing position errors (in the direction in which the nozzles are aligned), ejected droplet volume errors, and no ejection errors (i.e., the ejected droplet volume is zero). FIG. 17 is an illustrative diagram showing a schematic view of examples of variations in the ejection characteristics of nozzles, and density variations appearing the recording result.

In FIG. 17, a line head 300 has nozzles 302-i (where i=1 to 10) which eject droplets of ink toward a recording medium (for example, recording-paper) to form dots 304-i (i=1 to 10), respectively, on the recording medium. The recording medium is moved in the direction of an arrow S (the sub-scanning direction) relatively with respect to the line head 300.

In the embodiment shown in FIG. 17, a depositing position error occurs at the nozzle 302-3, which is third from the left, (more specifically, the droplet ejected from the nozzle 302-3 lands on the recording medium at a position diverging from the originally intended depositing position in the leftward direction in FIG. 17); a droplet volume error occurs at the sixth nozzle 302-6 (more specifically, the droplet ejected from the nozzle 302-6 has a greater droplet volume than the originally intended volume); and the ninth nozzle 302-9 fails to eject any droplet. In this embodiment, density non-uniformity streaks occur at the positions in the print image corresponding to the nozzles 302-3, 302-6 and 302-9 producing the depositing position error, the droplet volume error, and the ejection failure (namely, the positions indicated by A, B and C in FIG. 17).

In the case of a serial or shuttle-scanning type of image recording apparatus which performs image recording by driving a recording head to scan a plurality of times over the prescribed print region, it is possible to avoid density non-uniformities by means of a commonly known multi-pass printing method, but in the case of a line head system (full width array) which records images by means of a single scanning action, it is difficult to avoid density non-uniformities.

Since it is difficult to completely prevent variations in ejection characteristics among the nozzles in manufacturing terms, then various technologies for correcting the variations have been proposed (Japanese Patent Application Publication Nos. 5-69545, 2004-58282, and 2004-50430).

Japanese Patent Application Publication No. 5-69545 discloses technology (collective correction method) in which correctional data is created for each nozzle by outputting a uniform test pattern onto a medium and reading in the ink density optically, in order to correct density non-uniformities caused principally by liquid droplet volume errors. However, this technology has a possibility that inconsistency occurs between the position onto which a nozzle ejects ink and the position where the ink density is measured, because of the effects of depositing position errors, and therefore the non-uniformity correction accuracy may be poor (streaking may not be alleviated satisfactorily).

In order to further improve the accuracy of non-uniformity correction in the collective correction method described above, technology (individual correction method) has been proposed in which the error causes, such as depositing position error and ejection failure, are measured separately and are corrected individually (Japanese Patent Application Publication Nos. 2004-58282 and 2004-50430).

Japanese Patent Application Publication No. 2004-58282 discloses technology in which the aforementioned inconsistency due to depositing position errors is absorbed by specifying a value referred to as "protrusion surface area ratio", in order to primarily correct density non-uniformities caused by the depositing position errors.

Japanese Patent Application Publication No. 2004-50430 discloses technology for identifying a nozzle with an ejection failure and implementing corrections with respect to the nozzle. In this technology, output densities for nozzles surrounding a defective nozzle are determined selectively for each density region, and more specifically, Japanese Patent Application Publication No. 2004-50430 describes that it is desirable for the output densities of both adjacent nozzles of the defective nozzle to be multiplied by 1.5 times.

The principles of correction methods in the related art are now described generally with reference to FIG. 18. In FIG. 18, the third nozzle from the left (NZ3) has a depositing position error (namely, characteristics whereby the droplet ejected from the nozzle NZ3 lands on the recording medium at a position diverging from the originally intended depositing position, in the rightward direction in the diagram). The graph shown in the bottom part of FIG. 18 indicates the density profile in the nozzle column direction (main scanning direction), in which the print density produced by the droplets ejected from the nozzles is averaged per nozzle in the conveyance direction of the recording medium (the sub-scanning direction). The horizontal axis (X axis) represents the positions in the main scanning direction, and the vertical axis represents the optical density (O.D.).

In general terms, the correction principle described in Japanese Patent Application Publication No. 5-69545 is as described below.

Step 1: Firstly, the densities of areas (density measurement areas AR1 to AR5) corresponding to the ideal positions of nozzles NZ1 to NZ5 are measured (or they are calculated arithmetically from a prescribed model).

Step 2: The nozzle output values are specified on the basis of the area densities thus measured (or calculated), in such a manner that the area densities are made uniform.

In the case of FIG. 18, the density of the area AR3 is reduced in comparison with ideal droplet ejection (as indicated by the dashed line), whereas the density of the area AR4 is increased. Therefore, processing (output value correction) is carried out in order to raise the output value of the nozzle NZ3 and reduce the output value of the nozzle NZ4, in qualitative terms.

However, there is inconsistency between the nozzle position and the area position, and the output of the nozzle NZ3 affects the density of area AR4, for instance. Therefore, the area densities are not completely uniform, and hence errors remain. Consequently, the correction is not sufficient.

Although accuracy can be raised by loop processing of correction, it is necessary to perform the output and measurement a plurality of times (or to perform optimization calculation a plurality of times) in such a case, and this is highly complicated. Moreover, loop processing does not completely eliminate errors, and there are limitations on the correctional accuracy achieved.

Japanese Patent Application Publication No. 2004-58282 discloses correction processing which can be regarded as an improvement of the correction processing disclosed in Japanese Patent Application Publication No. 5-69545. To give a general description of the correction processing according to Japanese Patent Application Publication No. 2004-58282, (1) firstly, depositing position error information for each nozzle is acquired by means of a special test pattern; (2) the density characteristics of the print area corresponding to a particular nozzle are inferred by taking account of the effects of depositing position errors in the adjacent nozzles; and (3) output correction is carried out on the basis of the inferred density characteristics.

More specifically, as shown in FIG. 19, weighting relationship Z(NZ→AR) between the nozzle output and the area density is designated, and a nozzle control amount is specified on the basis of this weighting relationship Z, in such a manner that the area densities become uniform. FIG. 19 shows an example of weighting of the nozzle output, and the weighting relationship is specified by taking account of the surface area occupied by the dots, and the dot density profile (which is generally an approximate hemispherical shape as shown in FIG. 19).

In the case of the nozzle NZ3 shown in FIG. 18, for example, by taking account of the effects (density contribution) of the dot density profile (solid line) created due to the depositing position error, on the areas AR2, AR3 and AR4 as shown in FIG. 19, the values of the weighting relationship Z are expressed as follows: Z(3→2)=0.0, Z(3→3)=0.8, and Z(3→4)=0.2. By using such weighting relationship Z, the inconsistency between the nozzle position and the area position is removed, and control can be implemented more precisely in order to make the area densities uniform.

SUMMARY OF THE INVENTION

However, even if the area densities are corrected to be equal to each other according to the above-mentioned method, the density profiles in the areas are different from each other as a result of depositing position errors, and hence the low-frequency component of the power spectrum (which represents the visibility of the density non-uniformity) is not reduced sufficiently. Therefore, although the density non-uniformity is reduced, the correction is not sufficient for making the density non-uniformity completely invisible.

Moreover, Japanese Patent Application Publication Nos. 2004-58282 and 2004-50430 propose technology for correcting depositing position errors and ejection failures independently. In an actual print head, these errors are mixed together and this should be taken into account if accurate correction is to be achieved; however, the related art does not resolve this technical issue.

For example, in the technology disclosed in Japanese Patent Application Publication No. 2004-50430, if a correction nozzle has a depositing position error, then the correction is not effective. More specifically, in a case where the correction nozzle (the nozzle to be corrected) has a depositing position error in the direction opposite to that of the defective nozzle, even if the output density is corrected to be 1.5 times, white streaking does not disappear completely.

The present invention has been contrived in view of the aforementioned circumstances, an object thereof being to provide an image recording apparatus and an image recording method capable of accurately correcting density non-uniformities arising due to errors in the recording characteristics of a recording element.

In order to attain the aforementioned object, the present invention is directed to an image recording apparatus, comprising: a recording head which has a plurality of recording elements; a conveyance device which causes the recording head and a recording medium to move relatively to each other by conveying at least one of the recording head and the recording medium; a characteristic information acquisition device which acquires information that indicates recording characteristics of the recording elements, the recording characteristics including recording position errors of the recording elements and errors in volume of droplets ejected from the recording elements; a correction range setting device which sets N correction recording elements (where N is an integer larger than 1) for use in correction of output density, from among the plurality of recording elements; a correction coefficient specification device which specifies density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero; a correction processing device which performs calculation for correcting the output density by using the density correction coefficients specified by the correction coefficient specification device; and a drive control device which controls driving of the recording elements according to correction results produced by the correction processing device.

According to this aspect of the present invention, even if there is both of a recording position error and an ejected liquid droplet volume error, it is possible to perform effective correction with respect to a density non-uniformity caused by these errors, and therefore the degree of the visible non-uniformity can be reduced.

Generally, irregularities in the density of a recorded image (density non-uniformities) can be represented by the intensity of the spatial frequency characteristics (power spectrum), and the visibility of the density non-uniformities can be evaluated by means of the low-frequency component of the power spectrum, because it is difficult for human eye to sense the high-frequency component, human vision has high sensitivity to the low-frequency component, and this sensitivity declines as the frequency increases. According to the present invention, since the density correction coefficients are specified by using conditions under which the differential coefficients at the frequency origin point (f=0) of the power spectrum after correction using the density correction coefficients become substantially zero, then the intensity of the power spectrum becomes a minimum at the frequency origin point and the power spectrum restricted to a low value in the vicinity of the origin (in other words, in the low-frequency region). Accordingly, highly accurate correction of non-uniformity can be achieved.

The "characteristic information acquisition device" may acquire information by storing information relating to recording failure positions, previously, in a storage device such as a memory, and then reading out the required information, or it may acquire information relating to recording characteristics by printing an actual test pattern, or the like, and then reading in and analyzing the print results. Considering that the recording characteristics change over time, a desirable mode is one in which the information is updated at suitable times.

The inkjet recording apparatus according to one mode of the image recording apparatus of the present invention comprises: a liquid ejection head (corresponding to a "recording head") having a droplet ejection element row in which a plurality of droplet ejection elements (corresponding to "recording elements") are arranged in a row, each droplet ejection element including a nozzle for ejecting an ink droplet in order to form a dot and a pressure generating device (piezoelectric element, heating element, or the like) which generates an ejection pressure; and an ejection control device which controls the ejection of droplets from the recording head on the basis of ink ejection data generated from the image data. An image is formed on a recording medium by means of the droplets ejected from the nozzles.

A compositional embodiment of recording head is a full line type head having a recording element row in which a plurality of recording elements (nozzles) are arranged through a length corresponding to the full width of the recording medium. In this case, a mode may be adopted in which a plurality of relatively short recording head modules having recording element rows which do not reach a length corresponding to the full width of the recording medium are combined and joined together, thereby forming recording element rows of a length that correspond to the full width of the recording medium.

A full line type head is usually disposed in a direction that is perpendicular to the relative feed direction (relative conveyance direction) of the recording medium, but a mode may also be adopted in which the recording head is disposed following an oblique direction that forms a prescribed angle with respect to the direction perpendicular to the conveyance direction.

"Recording medium" indicates a medium on which an image is recorded by means of the action of the recording head (this medium may also be called an image forming medium, print medium, image receiving medium, or, in the case of an inkjet recording apparatus, an ejection medium or ejection receiving medium, or the like). This term includes various types of media, irrespective of material and size, such as continuous paper, cut paper, sealed paper, resin sheets, such as OHP sheets, film, cloth, an intermediate transfer body, a printed circuit board on which a wiring pattern, or the like, is printed by means of an inkjet recording apparatus, and the like.

The "conveyance device" may include a mode where the recording medium is conveyed with respect to a stationary (fixed) recording head, or a mode where a recording head is moved with respect to a stationary recording medium, or a mode where both the recording head and the recording medium are moved.

When forming color images by means of an inkjet head, it is possible to provide recording heads for inks of a plurality of colors (recording liquids), or it is possible to eject inks of a plurality of colors from a single recording head.

Furthermore, the present invention is not limited to a full line head, and may also be applied to a serial (shuttle) scanning type recording head (a recording head which ejects droplets while moving reciprocally in a direction substantially perpendicular to the conveyance direction of the recording medium).

The "correction conditions" are expressed by, for example, N simultaneous equations obtained according to conditions for preserving a DC (Direct Current) component of the spatial frequency, and conditions at which the differential coefficients up to (N−1)-th order become substantially zero.

If the density correction coefficients are determined respectively for the N correction recording elements, then since there are N unknown numbers, N simultaneous equations are obtained by using conditions for preserving the DC component and conditions whereby the differential coefficients up to the (N−1)-th order become substantially zero. By solving these equations, it is possible to specify all of the unknown numbers.

Furthermore, by satisfying conditions whereby the higher order differential coefficients become substantially zero, the degree of increase in the power spectrum is further restricted with respect to increase in the frequency from the origin point of the frequency range, and the intensity of the low-frequency component is kept to a lower value.

Preferably, the density correction coefficients for the recording elements are specified by the following equation:

$$d_i = \begin{cases} \dfrac{1}{1+\Delta v_i} \cdot \dfrac{\prod_k x_k}{x_i \cdot \prod_{k \neq i} (x_k - x_i)} - 1 & \left(\begin{array}{c}\text{for a correction object recording element} \\ \text{of the recording elements}\end{array}\right) \\ \dfrac{1}{1+\Delta v_i} \cdot \dfrac{\prod_k x_k}{x_i \cdot \prod_{k \neq i} (x_k - x_i)} & \left(\begin{array}{c}\text{for a recording element of the recording elements,} \\ \text{other than the correction object recording element}\end{array}\right) \end{cases}$$

where i indicates a recording element of the recording elements and serves as an index identifying a position of the recording element i, $d_i$ is the density correction coefficient for the recording element i, $x_i$ is a recording position of the recording element i, $V_i$ is the volume of the droplet ejected from the recording element i, and $V_0$ is an ideal volume of the droplets ejected from the recording elements, and $\Delta v_i$ is the error in the volume of the droplet ejected from the recording element i defined as $$\Delta v_i = \frac{V_i}{V_0} - 1.$$

Looking in particular at the center of gravity position of the density profile, it is possible to obtain an equation for calculating the density correction coefficient by means of arithmetical processing using a δ function type of print model, which approximates the profile to a δ function. The application of the present invention to an actual apparatus is not limited to a mode where the precise solution provided by the above-described equation is used directly, and it is also possible to revise the value to a practicable value, by applying suitable correction to the precise solution.

In order to attain the aforementioned object, the present invention is also directed to an image recording apparatus, comprising: a recording head which has a plurality of recording elements; a conveyance device which causes the recording head and a recording medium to move relatively to each other by conveying at least one of the recording head and the recording medium; a characteristic information acquisition device which acquires information that indicates recording characteristics of the recording elements, the recording characteristics including recording position errors of the recording elements and ejection failures of the recording elements; a correction range setting device which sets N correction recording elements (where N is an integer larger than 1) for use in correction of output density, from among the plurality of recording elements; a correction coefficient specification device which specifies density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero; a correction processing device which performs calculation for correcting the output density by using the density correction coefficients specified by the correction coefficient specification device; and a drive control device which controls driving of the recording elements according to correction results produced by the correction processing device.

According to this aspect of the present invention, even if there is both of a recording position error and an ejection failure, it is possible to perform effective correction with respect to a density non-uniformity caused by these errors, and therefore the degree of the visible non-uniformity can be reduced.

Moreover, since a case of the "ejection failure" corresponds to a case where the ejection liquid droplet volume is zero, then the concept of "ejected liquid droplet volume error" described above can include the "ejection failure". In implementing this aspect of the present invention, a desirable mode is one in which the density correction coefficients are specified on the basis of the recording characteristics including information on the recording position error, the ejected liquid droplet volume error and the ejection failure.

Preferably, the density correction coefficients for the recording elements are specified by the following equation:

$$d_i = \begin{cases} -1 \left( \begin{array}{c} \text{for a correction object recording} \\ \text{element of the recording elements} \end{array} \right) \\ \dfrac{-1}{1+\Delta v_i} \cdot \dfrac{\prod_k x_k}{x_i \cdot \prod_{k \neq i} (x_k - x_i)} \\ \left( \begin{array}{c} \text{for a recording element of the recording elements,} \\ \text{other than the correction object recording element} \end{array} \right) \end{cases}$$

where i indicates a recording element of the recording elements and serves as an index identifying a position of the recording element i, $d_i$ is the density correction coefficient for the recording element i, $x_i$ is a recording position of the recording element i, $V_i$ is volume of a droplet ejected from the recording element i, and $V_0$ is an ideal volume of droplets ejected from the recording elements, and $\Delta v_i$ is an error in the volume of the droplet ejected from the recording element i defined as $$\Delta v_i = \frac{V_i}{V_0} - 1.$$

When the correction object recording element has an ejection failure (i.e., inability of recording), that recording element suffering the ejection failure cannot contribute to the correction, and hence it is preferable that an optimum density correction coefficient be determined by using an adjacent recording element (a recording element other than the correction object recording element) which are to correct that ejection failure.

Preferably, if a surrounding recording element to be used in the correction of a correction object recording element of the recording elements suffers the ejection failure, the correction range setting device alters setting of the recording elements that are used in the correction in such a manner that the surrounding recording element suffering the ejection failure is not used in the correction.

Preferably, of the recording elements, a deteriorated recording element from which volume of a droplet ejected is not greater than 50% of a reference value is treated as a defective recording element suffering the ejection failure.

Since a recording element having very poor performance whereby the ejection liquid droplet volume is not greater than 50% of a prescribed reference value is restricted from use in the correction, it is possible to improve the non-uniformity reduction effect by treating a deteriorated recording element of this kind as a recording element suffering an ejection failure.

Preferably, i and k respectively indicate recording elements i and k of the recording elements and serve as indexes identifying the recording elements i and k; in relation to the recording position error of the recording element k, the density correction coefficients are specified for the N recording elements including the recording element k and a surrounding recording element which is located in a vicinity of the recording element k; d(i, k) is the density correction coefficient for the recording element i with respect to the recording position error of the recording element k; and a total density correction coefficient $d_i$ for the recording element i is obtained by linear combination of d(i, k) which are acquired by varying the k.

At any particular recording element i, density correction coefficients are determined respectively and independently with respect to the recording position errors of a plurality of recording elements, and the total density correction coefficient of that recording element i is determined by superimposition (linear combination) of the independently calculated density correction coefficients.

In this case, it is possible to take the depositing position error of all of the recording elements (all of the k values) as objects for correction and to determine the linear combination of all of the d(i, k) values accordingly, or it is also possible to determine the linear combination of the d(i, k) values relating to a portion of the index k values selected on the basis of certain conditions, for instance, by setting only those recording elements having a depositing position error exceeding a prescribed threshold value as objects for correction, or the like.

In order to attain the aforementioned object, the present invention is also directed to an image recording method for recording an image on a recording medium by a plurality of recording elements of a recording head while causing the recording head and the recording medium to move relatively to each other by conveying at least one of the recording head and the recording medium, the image recording method including the steps of: acquiring information that indicates recording characteristics of the recording elements, the recording characteristics including recording position errors of the recording elements and errors in volume of droplets ejected from the recording elements; setting N correction recording elements (where N is an integer larger than 1) for use in correction of output density, from among the plurality of recording elements; specifying density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero; performing calculation for correcting the output density by using the specified density correction coefficients; and controlling driving of the recording elements according to correction results produced from the calculation for correcting the output density.

In order to attain the aforementioned object, the present invention is also directed to an image recording method for recording an image on a recording medium by a plurality of recording elements of a recording head while causing the recording head and the recording medium to move relatively to each other by conveying at least one of the recording head and the recording medium, the image recording method including the steps of: acquiring information that indicates recording characteristics of the recording elements, the recording characteristics including recording position errors of the recording elements and ejection failures of the recording elements; setting N correction recording elements (where N is an integer larger than 1) for use in correction of output density, from among the plurality of recording elements; specifying density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero; performing calculation for correcting the output density by using the specified density correction coefficients; and controlling driving of the recording elements according to correction results produced from the calculation for correcting the output density.

Furthermore, it is also possible to provide an image processing method which comprises a correction processing step of performing a calculation for correcting the output density by using density correction coefficients specified by the method of specifying density correction coefficients. Of course, it is also possible to provide a program for causing a computer to implement the respective steps of the image processing method incorporating the method for specifying density correction coefficients used in the above-described image processing method, and a correction processing step. The program may be used as an operating program of a central processing unit (CPU) incorporated into a printer, and it may also be used in a computer system, such as a personal computer.

Furthermore, the program may be constituted by standalone applicational software, or it may be incorporated as a part of another application, such as image editing software. This program can be stored in a CD-ROM, a magnetic disk, or other information storage medium (an external storage device), and the program may be provided to a third party by means of such an information storage medium, or a download service for the program may be offered by means of a communications circuit, such as the Internet.

According to the present invention, it is possible to correct a density non-uniformity caused by variation in the recording characteristics of recording elements, with high accuracy, and hence an image of high quality can be formed.

BRIEF DESCRIPTION OF THE DRAWINGS

The nature of this invention, as well as other objects and advantages thereof, is explained in the following with reference to the accompanying drawings, in which like reference characters designate the same or similar parts throughout the figures and wherein:

FIG. 4 is a table showing an embodiment of selection of a correction coefficient generation method;

DETAILED DESCRIPTION OF THE PREFERRED EMBODIMENTS

First Embodiment

Application in Line Head

Figure 1:
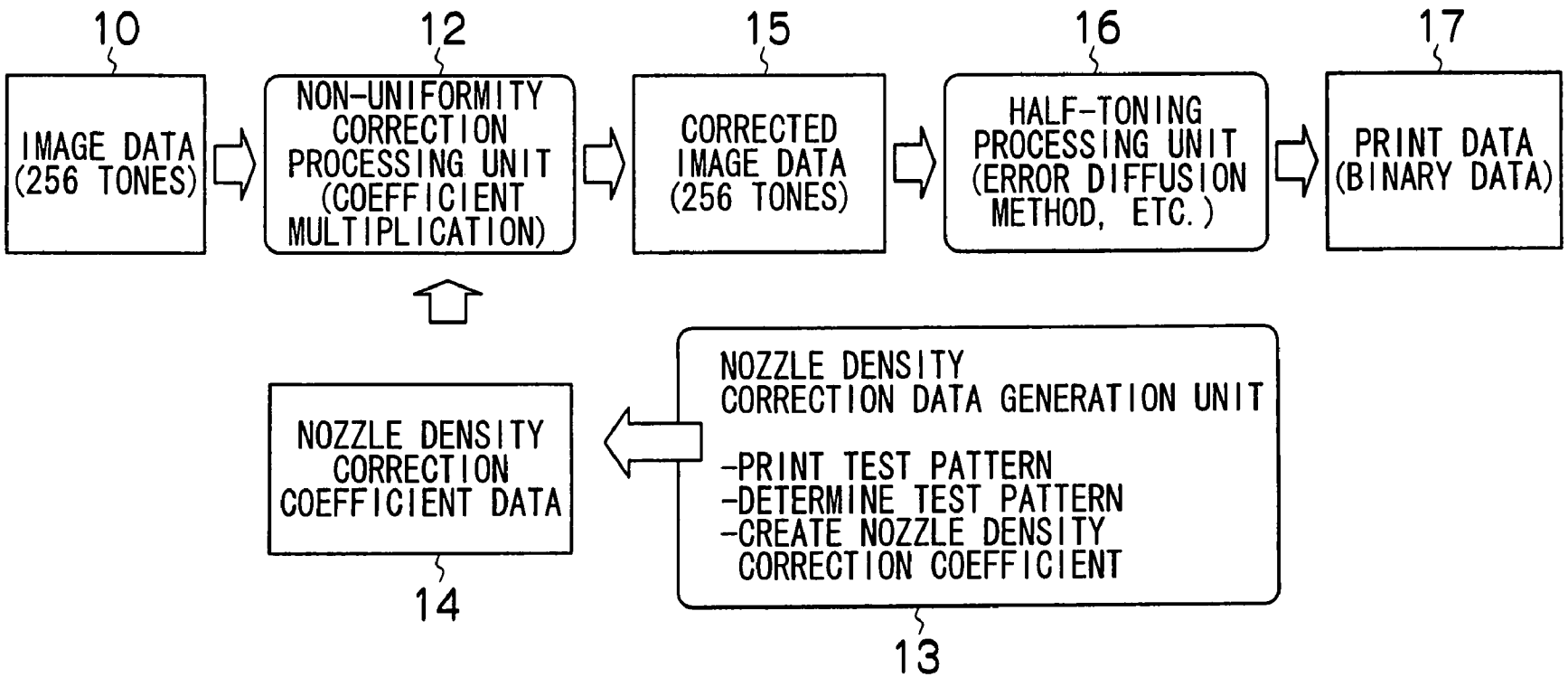
FIG. 1 is a flow diagram showing the sequence of image processing according to an embodiment of the present invention.

FIG. 1 is a flow diagram showing the sequence of image processing according to a first embodiment of the present invention. There are no particular restrictions on the data format of the input image 10, and for example, image data which has been subject to a color conversion in accordance with the ink colors used in the printer and is based on each ink color, can be adopted, and the density of the each ink color can be represented by 256 tonal graduations.

Figure 2:
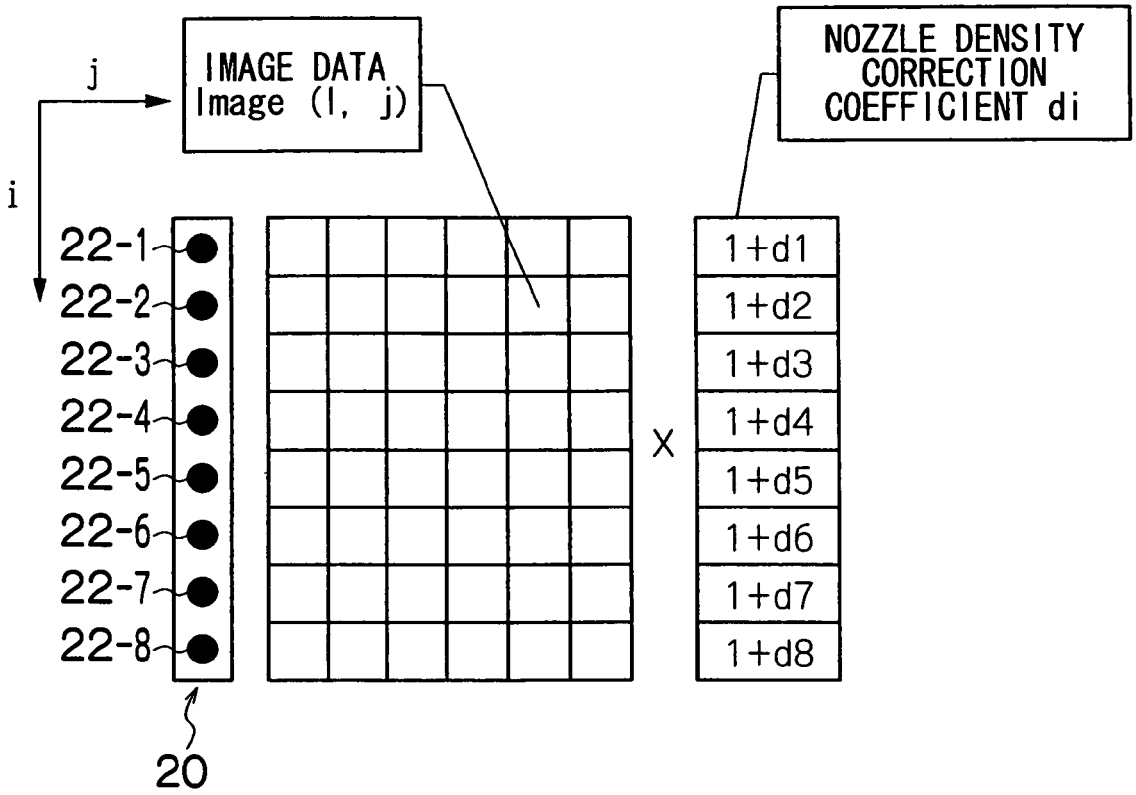
FIG. 2 is a conceptual diagram of density non-uniformity correction processing according to an embodiment of the present invention.

As shown in FIG. 2, the image data "Image(i, j)" for each color has the same resolution as the print resolution. For example, a print head can be employed in which: the head width is a 4 inch size; the nozzle density is 1200 npi (nozzles per inch); the number of nozzles is 4800 nozzles per color; and the print resolution is 1200 dpi×1200 dpi. However, in implementing the present invention, there are no particular restrictions on the specifications of the print head and the print resolution.

Here, (i, j) denotes the pixel position, where i expresses the position in the nozzle arrangement direction of the line head 20 and j expresses the position in the relative conveyance direction of the recording medium, which is perpendicular to the nozzle arrangement direction of the line head 20. The line head 20 has a total of M nozzles 22-i where the nozzle number i ranges from 1 to M (in FIG. 2, for the sake of convenience, only eight nozzles are shown). In other words, the pixel position (i, j) on the image is specified by the position (the position in the main scanning direction) "i" and the position "j" in the sub-scanning direction of the nozzle NZi, and image data indicating the tonal graduation value is assigned to each pixel.

In the non-uniformity correction processing unit 12 shown in FIG. 1, image correction is carried out with respect to the input image data, Image(i, j), by using a density correction coefficient $d_i$ for a nozzle corresponding to each pixel. The data of the density correction coefficient $d_i$ is generated by a nozzle density correction data generation unit 13, and is stored in a storage device such as a memory ("the nozzle density correction coefficient data storage unit" denoted with reference numeral 14 in FIG. 1). The details of the method of generating a density correction coefficient are described later.

The term "Image'(i, j)" denotes the corrected image data, and the correction processing in the non-uniformity correction processing unit 12 is the processing defined by the following equation (see FIG. 2):

$$\text{Image}'(i, j)=(1+d_i)\times\text{Image}(i, j).$$

In this way, the corrected image data (i.e., the image data which is denoted by reference numeral 15 in FIG. 1 and has 256 graduated tones in the present embodiment) is obtained. The corrected image data, Image'(i, j), is input to a half-toning processing unit 16, and it is converted from a graduated tonal image into print data (binary data) 17 by using a commonly known binarization technique, such as an error diffusion method or a dithering method, in the half-toning processing unit 16.

The ink ejection (droplet ejection) data for each nozzle is generated on the basis of the binary data obtained in this way, and the ejection operation is controlled accordingly. Consequently, density non-uniformities are suppressed and an image of high quality can be formed.

Description of Method for Generating Nozzle Density Correction Coefficients

The procedure for generating correction data in the nozzle density correction data generation unit 13 shown in FIG. 1 is described below.

Firstly, the following three types of errors are measured (or estimated). More specifically, (1) the depositing position error (corresponding to the "recording position error") of each nozzle is determined; (2) the liquid droplet volume error (corresponding to the "ejected liquid droplet volume error") of each nozzle is determined; and (3) ejection failures are detected and nozzles suffering ejection failure are identified. For example, by printing a test pattern and then reading in the print results (measuring the printed test pattern), it is possible to determine the depositing position error, liquid droplet volume error, and ejection failures, and to identify nozzles suffering ejection failure. There are no particular restrictions on the determination methods, and it is possible to use the methods described in Japanese Patent Application Publication Nos. 5-69545, 2004-58282, and 2004-50430, and the like. The beneficial effects of the correction according to the present embodiment of the invention are unrelated to methods used for determining errors, and the like (in other words, they do not depend on methods for determining errors).

In the density non-uniformity correction processing according to this embodiment of the present invention, in order to correct printing errors that a certain nozzle may have, such as a depositing position error, a liquid droplet volume error, and an ejection failure, correction is performed by using N surrounding nozzles including that nozzle. The N nozzles used for this correction are called the "correction range nozzles". It is known that the greater the number N of nozzles used for the correction, the higher the achieved correction accuracy.

Figure 3:
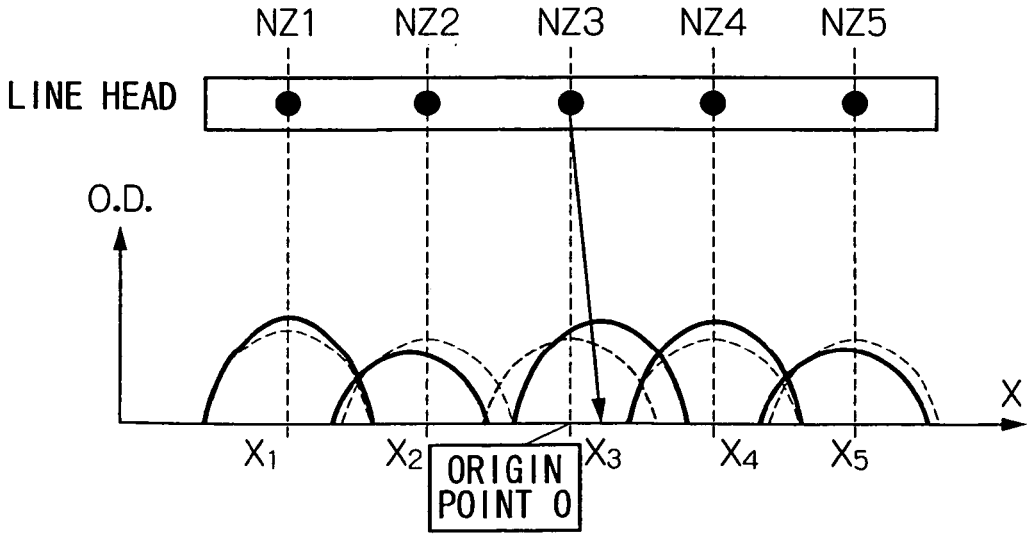
FIG. 3 is an illustrative diagram showing an embodiment of a density profile before correction of density non-uniformity according to an embodiment of the present invention.

FIG. 3 is a diagram showing a state (before correction) of printing with five nozzles, namely, nozzles NZ1 to NZ5. As shown in FIG. 3, the respective nozzles have various different print errors. The graph (denoted by thick lines) shown in the lower part of FIG. 3 denotes a density profile in the nozzle row direction (main scanning direction) which is obtained by averaging print densities created by droplets ejected from the nozzles, with respect to the conveyance direction of the recording medium (the sub-scanning direction). The profile denoted by dotted lines indicates an ideal density profile which contains no depositing position error and no liquid droplet volume error.

As shown in FIG. 3, the print error of each nozzle is represented by the divergence of the output density (thick lines) with respect to the ideal profile (dotted lines). In FIG. 3, the ideal depositing position of nozzle NZ3 is taken as the point of origin O, and the depositing positions of the liquid droplets ejected from nozzles NZ1 to NZ5 are taken to be Xi (where i=1 to 5 in FIG. 3). If nozzle NZ3 is a correction object nozzle, and the number (N) of correction range nozzles is set to 3, then correction is carried out by modifying the output densities of the nozzles NZ2, NZ3 and NZ4 in accordance with the print error of nozzle NZ3.

It is preferable that the density correction coefficient $d_i$ of each nozzle be specified so as to minimize the visibility of the density non-uniformities. Density non-uniformities in the print image are represented by the intensities in the spatial frequency characteristics (power spectrum). Since high-frequency component are not readily visible for human eye because of the characteristics of human vision, the visibility of the density non-uniformities corresponds to the low-frequency component of the power spectrum. Hence, in the present embodiment, the density correction coefficient $d_i$ for each nozzle is specified so as to minimize the low-frequency component of the power spectrum.

More specifically, the nozzle density correction coefficients $d_i$ are generated in the following manner.

Firstly, the correction coefficient generation method is selected in accordance with whether or not an ejection failure nozzle is present in the correction range nozzles. The selection method follows the table shown in FIG. 4 (which shows an example for N=3). In the table shown in FIG. 4, "good" denotes a normal nozzle and "poor" denotes a nozzle suffering an ejection failure (non-ejection).

As shown in FIG. 4, situations are classified into four different cases, in dependence upon the circumstances regarding the presence of an ejection failure nozzle in the correction range nozzles, and the correction coefficient generation method is different for each of these cases.

The first case is one where there is no ejection failure in any of the correction range nozzles. A case of this kind is a normal case, and the correction coefficient generation method is set as "A" in this case.

The second case is one where there is one ejection failure nozzle and the correction object nozzle suffers the ejection failure. In this case, an object of the correction is to correct the white streaking caused by the ejection failure. The correction coefficient generation method is set as "B" in this case.

The third case is one where there is one ejection failure nozzle and a nozzle other than the correction object nozzle suffers the ejection failure. In this case, although the correction object nozzle is not suffering an ejection failure, the nozzles to be used for the correction include the nozzle that cannot be used (i.e., the ejection failure nozzle). The correction coefficient generation method is set to "C" in this case.

The fourth case is one where there are two or more ejection failure nozzles. In this case, the potential streaking is judged to be uncorrectable and the procedure transfers to a head cleaning mode.

If there is a nozzle which can perform an ink ejection and from which the liquid droplet volume, dot shape, or the like, of an ink droplet ejected is markedly deteriorated, then better results in terms of non-uniformities are obtained by regarding that nozzle as an ejection failure nozzle, rather than using that nozzle to print beyond the limits of reason, when the image correction is carried out by creating the correction coefficients. From experimental is results, it is known that more desirable correction can be achieved by implementing the processing so as to regard any nozzle reaching a liquid droplet volume error of 50% or above as an ejection failure nozzle.

Next, the nozzle density correction coefficient generation methods A to C are described below.

Correction Coefficient Generation Method A

In the above-described first (normal) case, the density correction coefficients di corresponding to the depositing position error of a particular nozzle (correction object nozzle) is specified by means of the following equation:

$$d_i = \begin{cases} \dfrac{1}{1+\Delta v_i} \cdot \dfrac{\prod_k x_k}{x_i \cdot \prod_{k \neq i} (x_k - x_i)} - 1 & \left(\begin{array}{l}\text{for the correction}\\ \text{object nozzle}\end{array}\right) \\ \dfrac{1}{1+\Delta v_i} \cdot \dfrac{\prod_k x_k}{x_i \cdot \prod_{k \neq i} (x_k - x_i)} & \left(\begin{array}{l}\text{for nozzles other than the}\\ \text{correction object nozzle}\end{array}\right), \end{cases}$$

where i is the nozzle number; $x_i$ is the depositing position of each nozzle, taking the origin at the ideal depositing position of the correction object nozzle; Π means that the product is found for the N nozzles used for correction; and $\Delta v_i$ is a parameter representing the droplet volume error of the i-th nozzle, and is defined as $$\Delta v_i = \frac{V_i}{V_0} - 1,$$

where $V_0$ is the ideal (designed) averaged droplet volume, and $V_i$ is the droplet volume of the i-th nozzle.

When stated explicitly for the case of N=3, the following equations are derived:

$$d_2 = \frac{1}{1+\Delta v_2} \cdot \frac{x_2 \cdot x_3 \cdot x_4}{x_2 \cdot (x_3 - x_2) \cdot (x_4 - x_2)};$$

$$d_3 = \frac{1}{1+\Delta v_3} \cdot \frac{x_2 \cdot x_3 \cdot x_4}{x_3 \cdot (x_2 - x_3) \cdot (x_4 - x_3)} - 1; \text{ and}$$

$$d_4 = \frac{1}{1+\Delta v_4} \cdot \frac{x_2 \cdot x_3 \cdot x_4}{x_4 \cdot (x_2 - x_4) \cdot (x_3 - x_4)}.$$

Calculating Density Correction Coefficients in the Correction Coefficient Generation Method A The calculation of density correction coefficients according to the correction coefficient generation method A is described below. Here, a case involving a very slight liquid droplet volume error is considered. This method is not used in respect of ejection failures or marked liquid droplet volume errors (50% or above). Therefore, basically, the error in the liquid droplet volume can be corrected by means of the density correction coefficient of that nozzle. In other words, a depositing position error is corrected by using N surrounding nozzles, and a liquid droplet volume error is corrected by using one of the surrounding nozzles.

The parameters used in the descriptions are defined as follows.

i is the nozzle number;

$D_i$ is the output density;

$x_i$ is the depositing position, and is represented as: $x_i = \bar{x}_i + \Delta x_i$, where $\bar{x}$ is the ideal depositing position and $\Delta x_i$ is the depositing position error;

$\Delta v_i$ is the droplet volume error;

the output density before the correction is represented as:

$$D_i = \begin{cases} D_{INI} \cdot (1+\Delta v_i) & \text{(for the correction object nozzle)} \\ 0 & \left(\begin{array}{l}\text{for nozzles other than the}\\ \text{correction object nozzle}\end{array}\right); \end{cases}$$

$d_i$ is the density correction coefficient; and the output density after the correction is represented as:

$$D_i = \begin{cases} D_{INI} \cdot (1+\Delta v_i) + d_i \cdot D_{INI} \cdot (1+\Delta v_i) & \left(\begin{array}{l}\text{for the correction}\\ \text{object nozzle}\end{array}\right) \\ 0 + d_i \cdot D_{INI} \cdot (1+\Delta v_i) & \left(\begin{array}{l}\text{for nozzles other than the}\\ \text{correction object nozzle}\end{array}\right). \end{cases}$$

It is possible to logically derive the density correction coefficient for each nozzle from the conditions for minimizing the low-frequency component of the power spectrum of the density non-,uniformity.

Firstly, a density profile D(x) incorporating the error characteristics of each nozzle is defined as:

$$D(x) = \sum_i D_i \cdot z(x - x_i),$$

where i is the nozzle number, x is the positional coordinate on the medium (in the nozzle column direction), $D_i$ is the nozzle output density (the height of peak), z(x) is the standard density profile (where x=0 is the center of gravity), and $x_i=\bar{x}_i+\Delta x_i$ is the depositing position of the i-th nozzle (the ideal position+the error).

The density profile D(x) of the image is the sum of the density profiles printed by the nozzles, and the print model represents the printing performed by each nozzle (the density profile printed by each nozzle). The print model is represented separately by the nozzle output density $D_i$ and the standard density profile z(x).

The standard density profile z(x) has a limited spread equal to the dot diameter in strict terms, but if the correction of positional errors is considered to be a problem of balancing divergences in the density, then the important element is the central position (depositing position) of the density profile and the spread of the density profile is a secondary factor. Hence, an approximation that converts the profile by means of a δ function is appropriate. When a standard density profile represented with a δ function is supposed, then an arithmetical treatment can be achieved readily, and a precise solution for the correction coefficients can be obtained.

Figure 5:
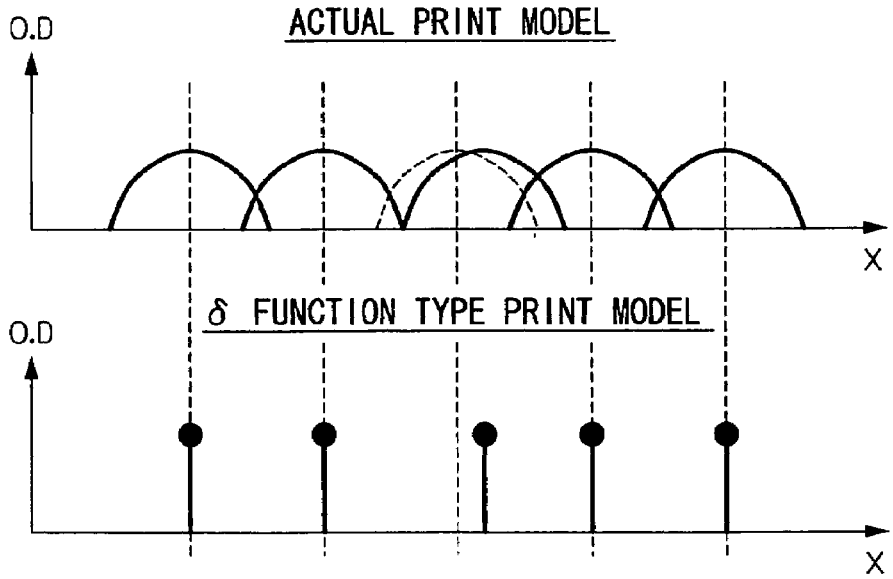
FIG. 5 is a graph of density profiles of an actual print model and a δ function type of print model.

FIG. 5 shows a graph of density profiles of an actual print model and a δ function type of print model. The standard density profile is represented as approximation using the δ function model as:

$$z(x-x_i)=\delta(x-x_i).$$

In calculating the correction coefficients, it is considered that the depositing position error $\Delta x_0$ of a particular nozzle (i=0) is to be corrected by means of the N pieces of nozzles including the particular nozzle and the nozzles surrounding the particular nozzle. Here, the number of the nozzle to be corrected is i=0. Attention is paid to the fact that each of the surrounding nozzles may also have a prescribed depositing position error.

The numbers (indexes) of the N nozzles including the nozzle to be corrected (central nozzle) are represented as:

$$\text{Nozzle index: } i=-\frac{N-1}{2},\ \ldots,\ -1,\ 0,\ 1,\ \ldots,\ \frac{N-1}{2}.$$

The number N must be an odd number in this expression, but in implementing the present invention, the number N is not necessarily limited to being an odd number.

The initial output density (the output density before correction) has a value only if i=0, and is represented as follows:

$$D_i=\begin{cases} D_{INI}\cdot(1+\Delta v_i) & \text{(for the correction object nozzle)} \\ 0 & \left(\begin{array}{l}\text{for nozzles other than the}\\ \text{correction object nozzle}\end{array}\right)\end{cases}.$$

When the density correction coefficients are $d_i$, then the output densities $D_i$ after correction are represented as follows:

$$D_i=d'_i\times D_{INI},$$

where

-continued $$d'_i=\begin{cases} \dfrac{1+d_i}{1+\Delta v_i} & \text{(for the correction object nozzle)} \\ \dfrac{d_i}{1+\Delta v_i} & \left(\begin{array}{l}\text{for nozzles other than the}\\ \text{correction object nozzle}\end{array}\right)\end{cases}.$$

The depositing position $x_i$ of each nozzle i is represented as:

$$x_i=\bar{x}_i+\Delta x_i,$$

where $\bar{x}_i$ is the ideal depositing position, and $\Delta x_i$ is the depositing position error.

When using a δ function type of print model, the density profile after correction is expressed as follows:

$$D(x)=\sum_{i=-(N-1)/2}^{i=(N-1)/2} D'_i\cdot\delta(x-x_i)=D_{INI}\cdot\sum_{i=-(N-1)/2}^{i=(N-1)/2} d'_i\cdot\delta(x-x_i).$$

By Fourier transform on this equation, the following equation is obtained:

$$T(f)=\int_{-\infty}^{\infty}D(x)\cdot e^{ifx}dx=\sum_i d'_i\cdot\int_{-\infty}^{\infty}\delta(x-x_i)\cdot e^{ifx}dx=\sum_i d'_i\cdot e^{ifx_i},$$

where $D_{INI}$ is omitted (more specifically, it is defined as $D_{INI}=1$) since it is a common constant.

Minimizing the visibility of density non-uniformities means minimizing the low-frequency component of the power spectrum expressed as:

$$\text{Power spectrum}=\int T(f)^2df.$$

This can be approximated arithmetically by taking the differential coefficients (of the first-order, the second-order, . . . ) for f=0 in T(f) to be zero. Since there are N unknown numbers $d'_i$, then if conditions are used where the differential coefficients up to the (N−1)-th order are zero, and also including the condition for maintaining the direct current (DC) component, then all (N) of the unknown numbers $d'_i$ can be specified precisely. Thus, the following correction conditions are specified:

$$\begin{array}{ll}
\text{DC component} & T(f=0)=1\left(\begin{array}{c}\text{condition for preserving}\\ \text{the DC component}\end{array}\right); \\
\text{First-order coefficient} & \dfrac{d}{df}T(f=0)=0; \\
\text{Second-order coefficient} & \dfrac{d^2}{df^2}T(f=0)=0; \\
\ldots & \\
(N-1)\text{-}th\text{ order coefficient} & \dfrac{d^{N-1}}{df^{N-1}}T(f=0)=0.
\end{array}$$

In the δ function model, when the correction conditions are developed, N simultaneous equations relating to Di are reached by means of a simple calculation. When the correction conditions are rearranged, the following group of conditions (group of equations) is obtained:

$$\sum d_i' = 1;$$

$$\sum x_i d_i' = 0;$$

$$\sum x_i^2 d_i' = 0;$$

$$\cdots$$

$$\sum x_i^{N-1} d_i' = 0.$$

The meaning of this group of equations is that the first equation represents the preservation of the DC component and the second equation represents the preservation of the central position. The third and subsequent equations represent the fact that the (N−1)-th moment in the statistical calculation is zero.

The conditional equations thus obtained can be represented with a matrix format as follows:

$$\begin{pmatrix} 1 & \cdots & 1 & \cdots & \cdots & 1 \\ x_{-(N-1)/2} & \cdots & x_0 & \cdots & \cdots & x_{(N-1)/2} \\ x^2_{-(N-1)/2} & \cdots & x_0^2 & & \cdots & x^2_{(N-1)/2} \\ \vdots & & & \ddots & & \vdots \\ \vdots & & & & \ddots & \vdots \\ x^{N-1}_{-(N-1)/2} & \cdots & x_0^{N-1} & \cdots & \cdots & x^{N-1}_{(N-1)/2} \end{pmatrix} \begin{pmatrix} d'_{-(N-1)/2} \\ \vdots \\ \vdots \\ d_0' \\ \vdots \\ d'_{(N-1)/2} \end{pmatrix} = \begin{pmatrix} 1 \\ 0 \\ \vdots \\ 0 \\ \vdots \\ 0 \end{pmatrix}.$$

This coefficient matrix A is a so-called Vandermonde matrix, and it is known that this matrix equation can be converted to the following equation, by using the product of the differences:

$$|A| = \prod_{j>k} (x_j - x_k).$$

It is hence possible to determine the precise solution of $d'_i$ using the Crammer's formula. The detailed sequence of the calculation is omitted here, but by means of algebraic calculation, the following solution is obtained:

$$d_i' = \frac{\prod_k x_k}{x_i \cdot \prod_{k \neq i} (x_k - x_i)},$$

where Π means that the product is found, and k beneath Π takes each of values of the nozzle numbers of the N pieces of nozzles including the particular nozzle and the nozzles surrounding the particular nozzle.

The equation is solved, so that the correction coefficients $d_i$ are determined as follows:

$$d_i = \begin{cases} \dfrac{1}{1+\Delta v_i} \cdot \dfrac{\prod_k x_k}{x_i \cdot \prod_{k \neq i} (x_k - x_i)} - 1 & \text{(for the correction object nozzle)} \\ \dfrac{1}{1+\Delta v_i} \cdot \dfrac{\prod_k x_k}{x_i \cdot \prod_{k \neq i} (x_k - x_i)} & \text{(for nozzles other than the correction object nozzle)} \end{cases}$$

Thus, the precise solution for the density correction coefficients $d_i$ is found, from the conditions where the differential coefficients at the origin of the power spectrum become zero. As the number of nozzles N used in the correction increases, the possibility of making the higher-order differential coefficients become zero increases, and hence, the low-frequency energy becomes smaller and the visibility of non-uniformities is reduced yet further.

In the present embodiment, the conditions where the differential coefficients at the origin become zero are used, but if the differential coefficients become sufficiently small values compared to the differential coefficients before the correction (such as 1/10 of the values before the correction), rather than being set completely to zero, it is still possible to make the density non-uniformity sufficiently small.

Correction Coefficient Generation Method B

In the second case described above, in other words, if the correction objection nozzle suffers an ejection failure, then the correction coefficients are determined by using the following equation:

$$d_i = \begin{cases} -1 & \text{(for the correction object nozzle)} \\ \dfrac{-1}{1+\Delta v_i} \cdot \dfrac{\prod_k x_k}{x_i \cdot \prod_{k \neq i} (x_k - x_i)} & \text{(for nozzles other than the correction object nozzle)} \end{cases}$$

The nozzle k does not print a dot, and therefore $d_i$ is taken to be $d_i=-1$.

This equation shows optimum density correction coefficients in a case where a depositing position error or a liquid droplet volume error are present in an adjacent nozzle which is to be corrected for the ejection failure.

Here, supposing that "N=3" is satisfied and there is no error other than the error of the ejection failure, the equations obtained are expressed as follows:

$\Delta v_i=0$, $x_{i-1}=-l$, $x_i=0$, $x_{i+1}=l$ (where l is an ideal distance between the nozzles). Hence, the correction coefficients are determined as follows: $d_2=0.5$, $d_3=-1$, and $d_4=0.5$.

Calculating Density Correction Coefficients in the Correction Coefficient Generation Method B Next, the calculation of density correction coefficients according to the correction coefficient generation method B is described below. Here, a case involving an ejection failure or a marked error in the liquid droplet volume (50% or above) is considered. In this case, the liquid droplet volume cannot be corrected by means of the correction object nozzle alone, and therefore correction is made by using surrounding nozzles. Moreover, in order to avoid divergence of the correction coefficients, the correction coefficient of the correction object nozzle is not controlled. Furthermore, since the object nozzle suffers an ejection failure (or the object nozzle can be regarded as an ejection failure nozzle), then the depositing position error can be taken to be zero.

The definitions of the parameters used are defined as follows.

i is the nozzle number, and is represented as, for the correction object nozzle: i=0 (ejection failure);

N is the number of nozzles used for the correction (uneven number of nozzles including the correction object nozzle);

$D_i$ is the output density;

$x_i$ is the depositing position, and is represented as: $x_i=\bar{x}_i+\Delta x_i$, where $\bar{x}_i$ is the ideal depositing position and $\Delta x_i$ is the depositing position error;

$\Delta v_i$ is the droplet volume error, and is represented as, for the correction object nozzle: $\Delta v_0=-1$ (because of the deemed non-ejection (regarded ejection failure)

the output density before the correction is represented as.

$$D_i = \begin{cases} D_{INI}\cdot(1+\Delta v_i) & (i=0) \\ 0 & (i\neq 0) \end{cases};$$

$d_i$ is the density correction coefficient; and the output density after the correction is represented as $$D_i = \begin{cases} (1+d_i)\cdot D_{INI}\cdot(1+\Delta v_i) & (i=0) \\ 0+d_i\cdot D_{INI}\cdot(1+\Delta v_i) & (i\neq 0) \end{cases}$$

(in a case where i=0, the density correction is not carried out because of the ejection failure, and therefore, $d_0=-1$).

When finding the power spectrum minimization solution, the correction object nozzle is not controlled, and therefore the number of unknown numbers is N−1. In this case, the power spectrum minimization conditions are expressed as follows. In the following conditions, the case of i=0 is excluded from the sum (for Σ) and $D_{INI}$ is taken to be $D_{INI}=1$.

Preservation of DC component:

$$\sum_i D_i = -\Delta v_0 = 1$$

Preservation of the first moment:

$$\sum_i x_i D_i = 0$$

Preservation of the (N−2)-th moment:

$$\sum_i x_i^{N-2} D_i = 0$$

In this way, the formation of the simultaneous equations does not change at all with respect to the example described above. Therefore, the solution is as follows:

$$D_i = \begin{cases} 1+\Delta v_i & (i=0) \\ (-\Delta v_0)\cdot\dfrac{\prod_k x_k}{x_i\cdot\prod_{k\neq i}(x_k-x_i)} & (i\neq 0) \end{cases}.$$

Attention should be paid to excluding the case of k=0 from the operation of the Π function.

By solving these equations for $d_i$, finally, the correction coefficients are obtained as follows:

$$d_i = \begin{cases} -1 & (i=0) \\ \dfrac{-\Delta v_0}{1+\Delta v_i}\cdot\dfrac{\prod_k x_k}{x_i\cdot\prod_{k\neq i}(x_k-x_i)} & (i\neq 0) \end{cases}.$$

Correction Coefficient Generation Method C

In the third case described above, if a nozzle surrounding the correction object nozzle "j" suffers an ejection failure, then that nozzle cannot be used for the correction, and therefore it is necessary to change the range of "i". For example, if "N=3" is satisfied and the nozzle NZ2 suffers an ejection failure, then (1) the nozzle NZ2 is not used for the correction and correction coefficients are generated on the basis of NZ3 and NZ4 by taking N as N=2, or (2) NZ1 is added as a substitute for nozzle NZ2 and correction coefficients are generated by taking N as N=3.

In both of these cases, it is possible to use the same equations as those in the correction coefficient generation method A, and in the above case (1) in particular, the following equations are obtained:

$$d_2 = 0$$

$$d_3 = \frac{x_3\cdot x_4}{x_3\cdot(x_4-x_3)} - 1$$

$$d_4 = \frac{x_3\cdot x_4}{x_4\cdot(x_3-x_4)}$$

By creating the density correction coefficients in the way described above, it is possible to achieve the maximum reduction in the low-frequency component of the spatial frequency characteristics of the density non-uniformities, and highly accurate correction of density non-uniformities can be achieved.

The foregoing description relates to the method of specifying density correction coefficients relating to one particular nozzle (the nozzle NZ3). In actual practice, most of the nozzles in the head have some degree of depositing position errors, and therefore, it is desirable that corrections are performed in respect of the depositing position errors of these nozzles. In other words, the density correction coefficients for the surrounding N nozzles are determined with respect to these nozzles, and the total density correction coefficient for a nozzle is determined by finding the sum of the density correction coefficients obtained as described above.

More specifically, if the density correction coefficient for a nozzle i in relation to a nozzle k to be corrected is set to be d(i, k), then the total density correction coefficient $d_i$ for the nozzle i is obtained as follows:

$$d_i = \sum_k d(i, k).$$

In this embodiment, d(i, k) are accumulated for the index k assuming that the depositing position errors of all of the nozzles are to be corrected, but it is also possible to adopt a composition in which a certain value ΔX_thresh is set previously as a threshold value, and correction is performed selectively by setting as objects for correction only those nozzles that have a depositing position error exceeding this threshold value.

Streaking is significantly reduced by carrying out the image correction by the methods described above.

Figure 6:
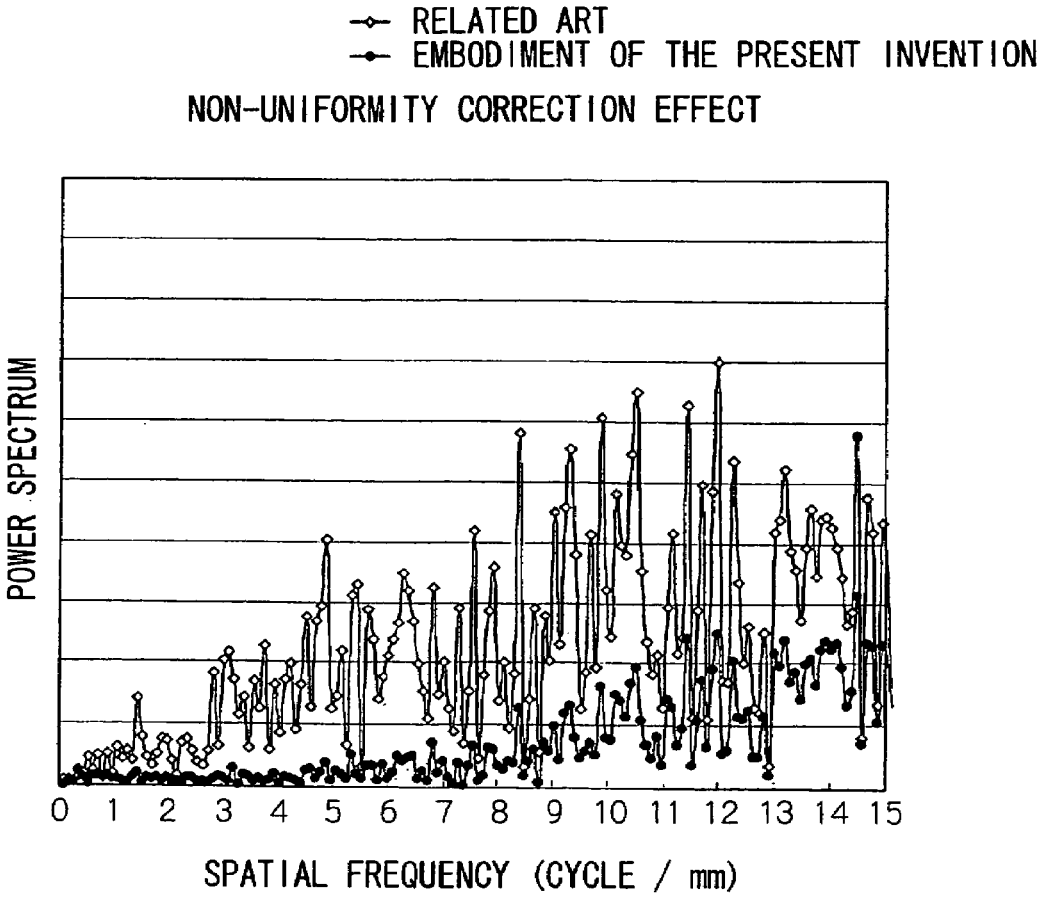
FIG. 6 is a graph of a power spectrum showing the results of the correction according to an embodiment of the present invention.

FIG. 6 is a diagram showing a comparison between results of the correction method in the related art and results of the correction method according to the present embodiment, and it shows the power spectrum obtained by measuring density non-uniformity and performing Fourier analysis. As shown in FIG. 6, in comparison with the correction method in the related art, the correction according to the present embodiment reduces the low-frequency energy and makes non-uniformities less readily visible.

The rationality of treating a nozzle where the ejected liquid droplet volume is 50% or less of the reference value, as a non-ejection nozzle (ejection failure nozzle), is explained below. If the ejection liquid droplet volume is less than 50% of the reference value, in other words, if the liquid droplet volume error Δv is less than "−0.5" (Δv<−0.5), then the density correction coefficient d (the density correction coefficient calculated for a depositing position error of zero) becomes greater than 1 according to the correction method A described above.

If the density correction coefficient d>1, then the output density of the corresponding nozzle is increased by more than two times, and due to the limitations of the ejection frequency of the head, this may give rise to failure of the image. Therefore, it is preferable for the density correction coefficient to be less than 1 (i.e., d<1).

Therefore, if a nozzle having a liquid droplet volume error which is less than −0.5 (Δv<−0.5) is regarded as an ejection failure nozzle, the correction is performed by using a plurality of surrounding nozzles in accordance with the correction method B described above. Consequently, increase in the density correction coefficients can be suppressed, and image break-up is prevented.

Due to the aforementioned reasons, preferably, the processing is carried out by regarding a nozzle of which the ejection liquid droplet volume is not greater than 50% of the reference value, as a nozzle suffering an ejection failure.

Figure 7:
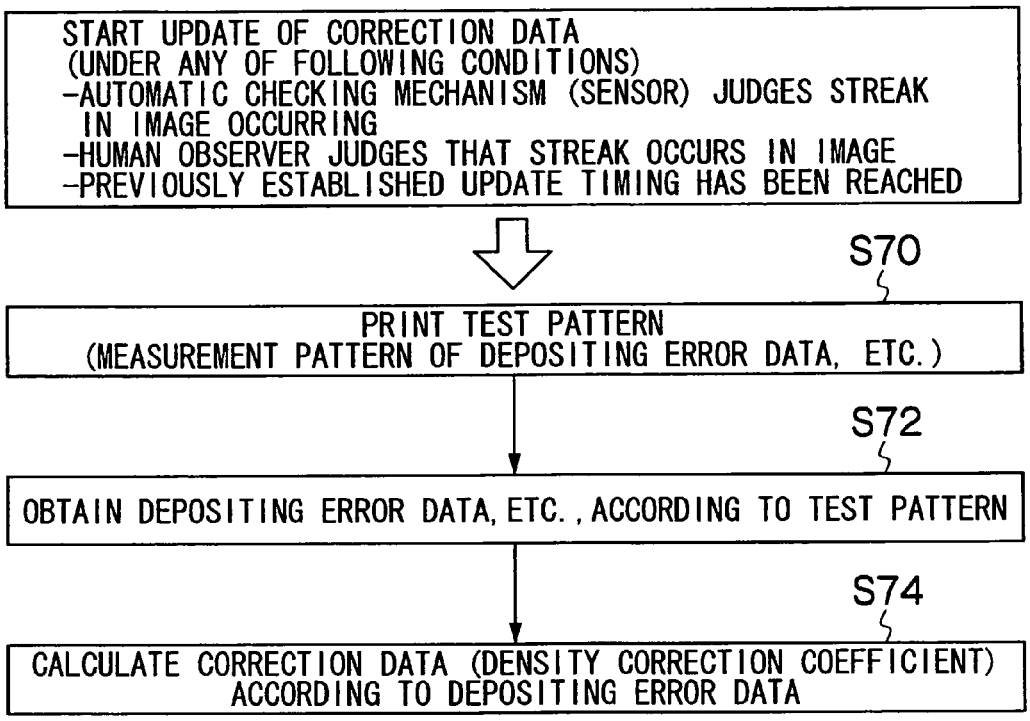
FIG. 7 is a flowchart showing a sequence of processing for updating the correction data.

FIG. 7 is a flowchart showing an embodiment of a process for updating the density correction coefficients (correction data). The correction data updating process starts when one of the following conditions applies, for instance.

In other words, the update processing shown in FIG. 7 starts if either: (a) an automatic checking device (sensor), which monitors the print result, judges that a non-uniformity streak has occurred in the printed image; or (b) a human observer judges that a non-uniformity streak has occurred in the printed image upon looking at the printed image, and performs a prescribed operation (such as inputting a command to start the updating process); or (c) a previously established update timing has elapsed (the update timing can be set and judged by means of time management based on a timer, or the like, or operational record management based on a print counter).

When the update process starts, firstly, a test pattern for obtaining data of the depositing position error, the droplet volume error, and the ejection failure (a prescribed pattern which is determined previously) is printed (step S70).

Next, the data of the depositing position error and the droplet volume error (including the ejection failure, in which the droplet volume is zero) is obtained on the basis of the print result of the test pattern (step S72). For this obtainment of the data of the depositing position error and the droplet volume error, it is possible to use an image reading device having an image sensor (imaging elements) (including a signal processing device for processing the captured image signal). The depositing error data includes, for example, information on depositing position error, information on optical density, and the like.

The correction data (density correction coefficients) is calculated from the data of the depositing position error and the droplet volume error obtained at step S72 (step S74). The method of calculating the density correction coefficients is described above.

The information relating to the density correction coefficients thus derived is stored in a rewriteable storage device, such as an EEPROM (electronically erasable and programmable read only memory), and subsequently, the most recent correction coefficients are used.

Composition of Inkjet Recording Apparatus

Next, an inkjet recording apparatus is described as an embodiment of the application of an image recording apparatus having the density non-uniformity correction function described above.

Figure 8:
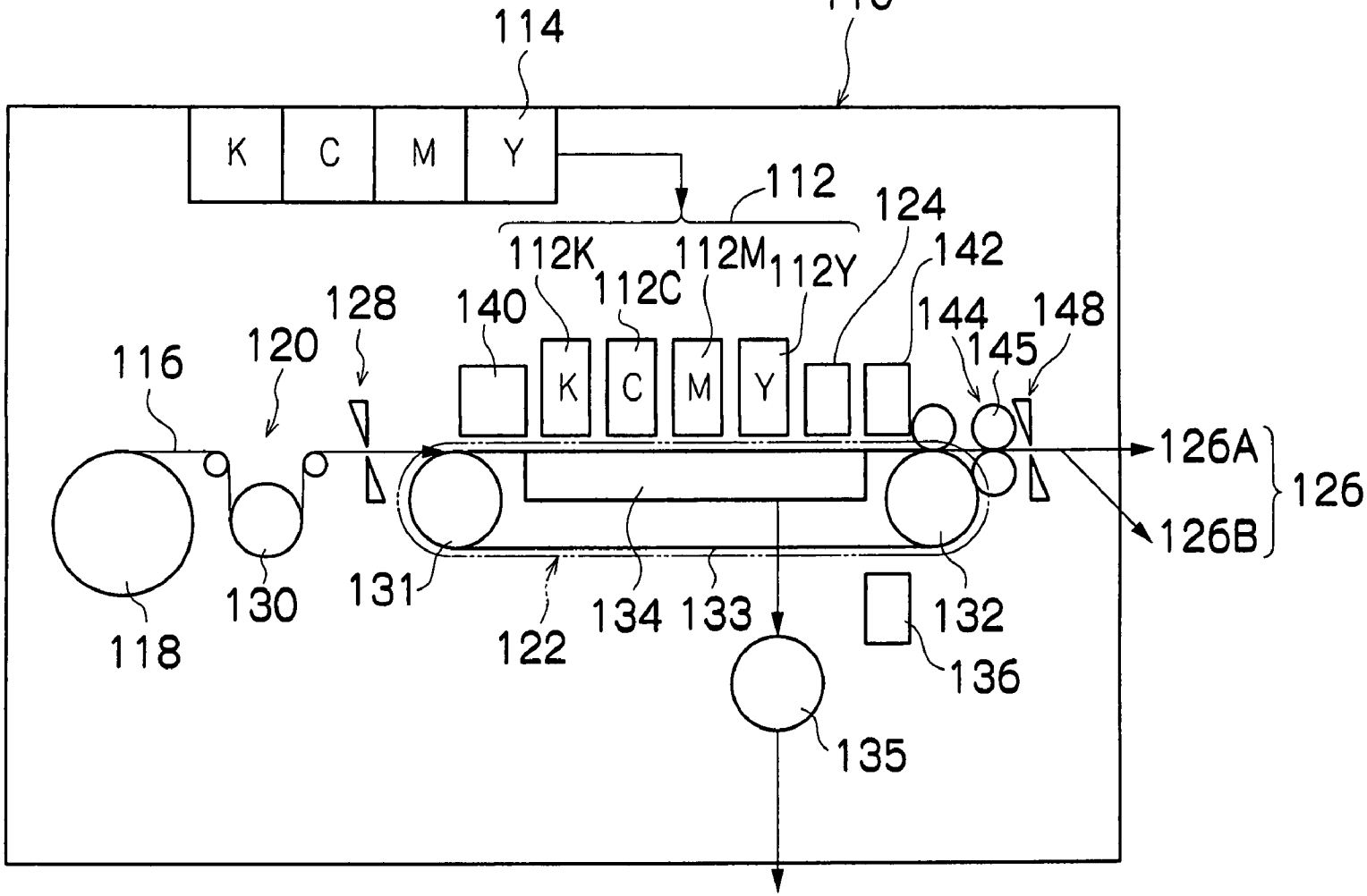
FIG. 8 is a general schematic drawing of an inkjet recording apparatus showing an image recording apparatus according to an embodiment of the present invention.

FIG. 8 is a general schematic drawing of an inkjet recording apparatus 110, which shows an image recording apparatus of an embodiment according to the present invention. As shown in FIG. 8, the inkjet recording apparatus 110 comprises: a print unit 112 having a plurality of inkjet recording heads (hereinafter referred to as heads) 112K, 112C, 112M, and 112Y provided for ink colors of black (K), cyan (C), magenta (M), and yellow (Y), respectively; an ink storing and loading unit 114 for storing inks to be supplied to the heads 112K, 112C, 112M and 112Y; a paper supply unit 118 for supplying recording paper 116 forming a recording medium; a decurling unit 120 for removing curl in the recording paper 116; a belt conveyance unit 122, disposed facing the nozzle face (ink ejection face) of the print unit 112, for conveying the recording paper 116 while keeping the recording paper 116 flat; a print determination unit 124 for reading the printed result produced by the print unit 112; and a paper output unit 126 for outputting the recorded recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 8, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording media can be used, it is preferable that an information recording medium such as a bar code and a wireless tag containing information about the type of recording medium be attached to the magazine, and by reading the information contained in the information recording medium with a predetermined reading device, the type of recording medium to be used is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 8, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the printing unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the printing unit 112 on the interior side of the belt 133, which is set around the rollers 131 and 132, as shown in FIG. 8. The suction chamber 134 provides suction with a fan 135 to generate a negative pressure, and the recording paper 116 is held on the belt 133 by suction. In place of the suction system, an electrostatic attraction system can be employed.

The belt 133 is driven in the clockwise direction in FIG. 8 by the motive force of a motor 188 (not shown in FIG. 8, but shown in FIG. 13) being transmitted to at least one of the rollers 131 and 132, which the belt 133 is set around, and the recording paper 116 held on the belt 133 is conveyed from left to right in FIG. 8.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration in which the belt is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus may comprise a roller nip conveyance mechanism, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the printing unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 9:
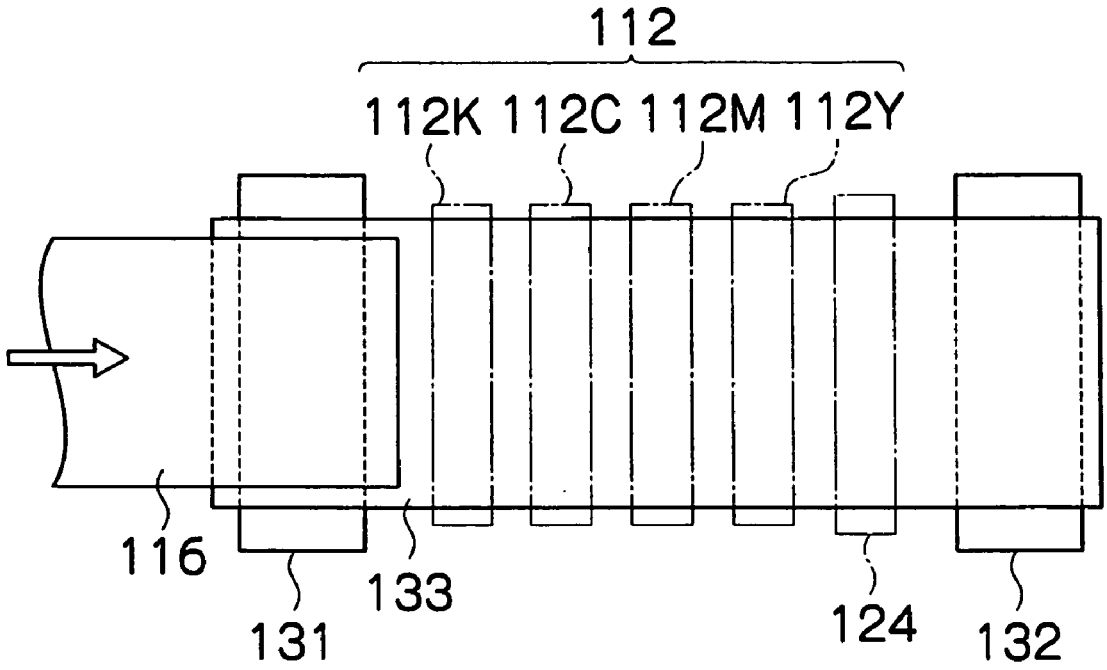
FIG. 9 is a principal plan diagram of the peripheral area of a print unit in the inkjet recording apparatus shown in FIG. 8.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 9).

The print heads 112K, 112C, 112M and 112Y are arranged in this color order (black (K), cyan (C), magenta (M), yellow (Y)) from the upstream side in the feed direction of the recording paper 116, and these heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 shown in FIG. 8 has an image sensor (line sensor or area sensor) for capturing an image of the droplet ejection result of the print unit 112, and functions as a device to check the ejection characteristics, such as blockages, depositing position error, and the like, of the nozzles, on the basis of the image of ejected droplets read in by the image sensor.

A CCD area sensor in which a plurality of photoreceptor elements (photoelectric transducers) are two-dimensionally arranged on the light receiving surface is suitable for use as the print determination unit 124 of the present embodiment. The area sensor has an imaging range that is capable of capturing an image of at least the full area of the ink ejection width (image recording width) of each of the heads 112K, 112C, 112M and 112Y. It is possible to achieve the required imaging range by means of one area sensor, or alternatively, it is also possible to ensure the required imaging range by combining (joining) a plurality of area sensors. Alternatively, a composition may be adopted in which the area sensor is supported on a movement mechanism (not shown), and an image of the required imaging range is captured by moving (by scanning with) the area sensor.

Furthermore, it is also possible to use a line sensor instead of the area sensor. In this case, a desirable composition is one in which the line sensor has rows of photoreceptor elements (rows of photoelectric transducing elements) with a width that is greater than the ink droplet ejection width (image recording width) of heads 112K, 112C, 112M and 112Y. A test pattern or the target image printed by the print heads 112K, 112C, 112M, and 112Y of the respective colors is read in by the print determination unit 124, and the ejection performed by each head is determined. The ejection determination includes the presence of the ejection, measurement of the dot size, and measurement of the dot depositing position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 8, the paper output unit 126A for the target prints is provided with a sorter for collecting prints according to print orders.

Structure of Head

Next, the structure of the head is described. The heads 112K, 112C, 112M and 112Y of the respective ink colors have the same structure, and a reference numeral 150 is hereinafter designated to any of the heads.

Figure 10A:
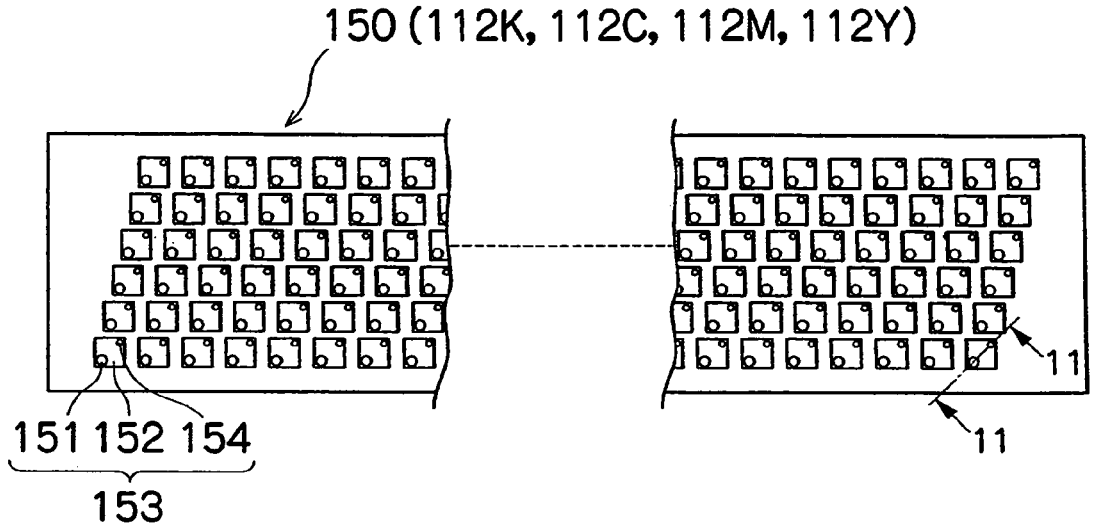
FIG. 10A is a plan view perspective diagram showing an embodiment of the composition of a print head.
Figure 10B:
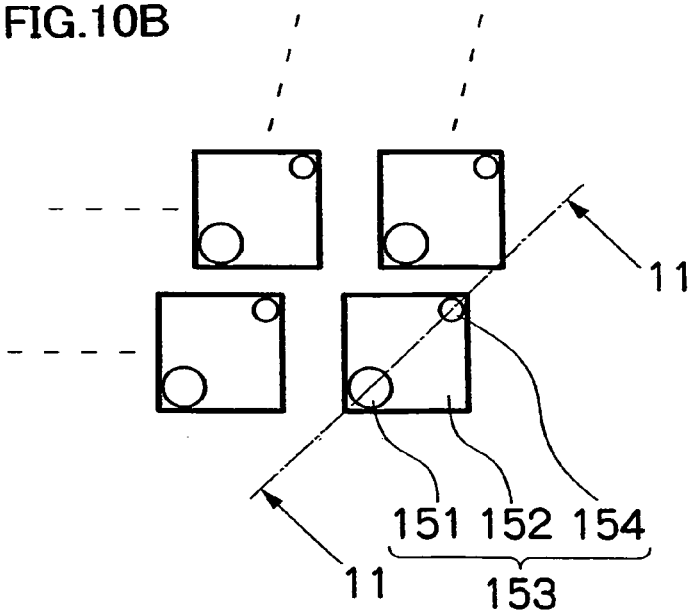
FIG. 10B is a principal enlarged view of FIG. 10A.
Figure 10C:
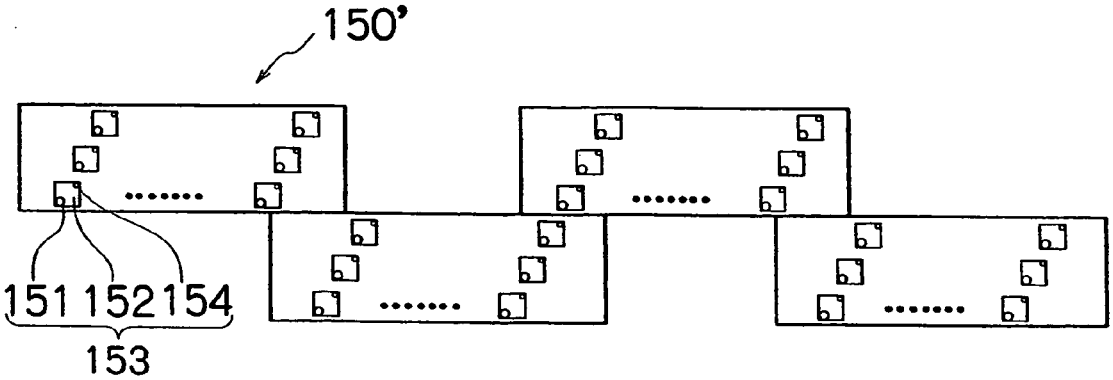
FIG. 10C is a plan view perspective diagram showing a further embodiment of the structure of a full line head.
Figure 11:
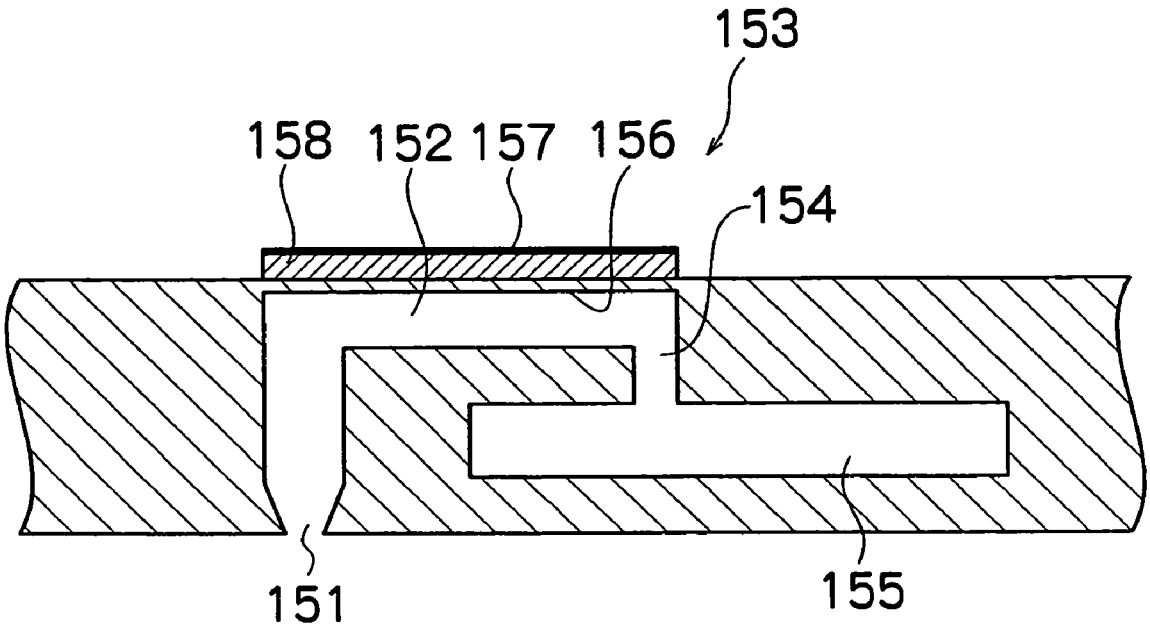
FIG. 11 is a cross-sectional view along line 11-11 in FIGS. 10A and 10B.

FIG. 10A is a perspective plan view showing an embodiment of the configuration of the head 150, FIG. 10B is an enlarged view of a portion thereof, FIG. 10C is a perspective plan view showing another embodiment of the configuration of the head 150, and FIG. 11 is a cross-sectional view taken along the line 11-11 in FIGS. 10A and 10B, showing the inner structure of a droplet ejection element (an ink chamber unit for one nozzle 151).

The nozzle pitch in the head 150 should be minimized in order to maximize the resolution of the dots printed on the surface of the recording paper 116. As shown in FIGS. 10A and 10B, the head 150 according to the present embodiment has a structure in which a plurality of ink chamber units (droplet ejection elements) 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the embodiment described above. For example, instead of the configuration in FIG. 10A, as shown in FIG. 10C, a line head having nozzle rows of a length corresponding to the entire width of the recording paper 116 can be formed by arranging and combining, in a staggered matrix, short head modules 150' each having a plurality of nozzles 151 arrayed in a two-dimensional fashion.

As shown in FIGS. 10A and 10B, the planar shape of the pressure chamber 152 provided corresponding to each nozzle 151 is substantially a square shape, and an outlet port to the nozzle 151 is provided at one of the ends of the diagonal line of the planar shape, while an inlet port (supply port) 154 for supplying ink is provided at the other end thereof. The shape of the pressure chamber 152 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

As shown in FIG. 11, each pressure chamber 152 is connected to a common channel 155 through the supply port 154. The common channel 155 is connected to an ink tank (not shown), which is a base tank that supplies ink, and the ink supplied from the ink tank is delivered through the common flow channel 155 to the pressure chambers 152.

An actuator 158 provided with an individual electrode 157 is bonded to a pressure plate (a diaphragm that also serves as a common electrode) 156 which forms the surface of one portion (in FIG. 11, the ceiling) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For the actuator 158, it is possible to adopt a piezoelectric element using a piezoelectric body, such as lead zirconate titanate, barium titanate, or the like. When the actuator 158 returns to its original position after ejecting ink by the displacement, the pressure chamber 152 is replenished with new ink from the common flow channel 155, through the supply port 154.

Figure 12:
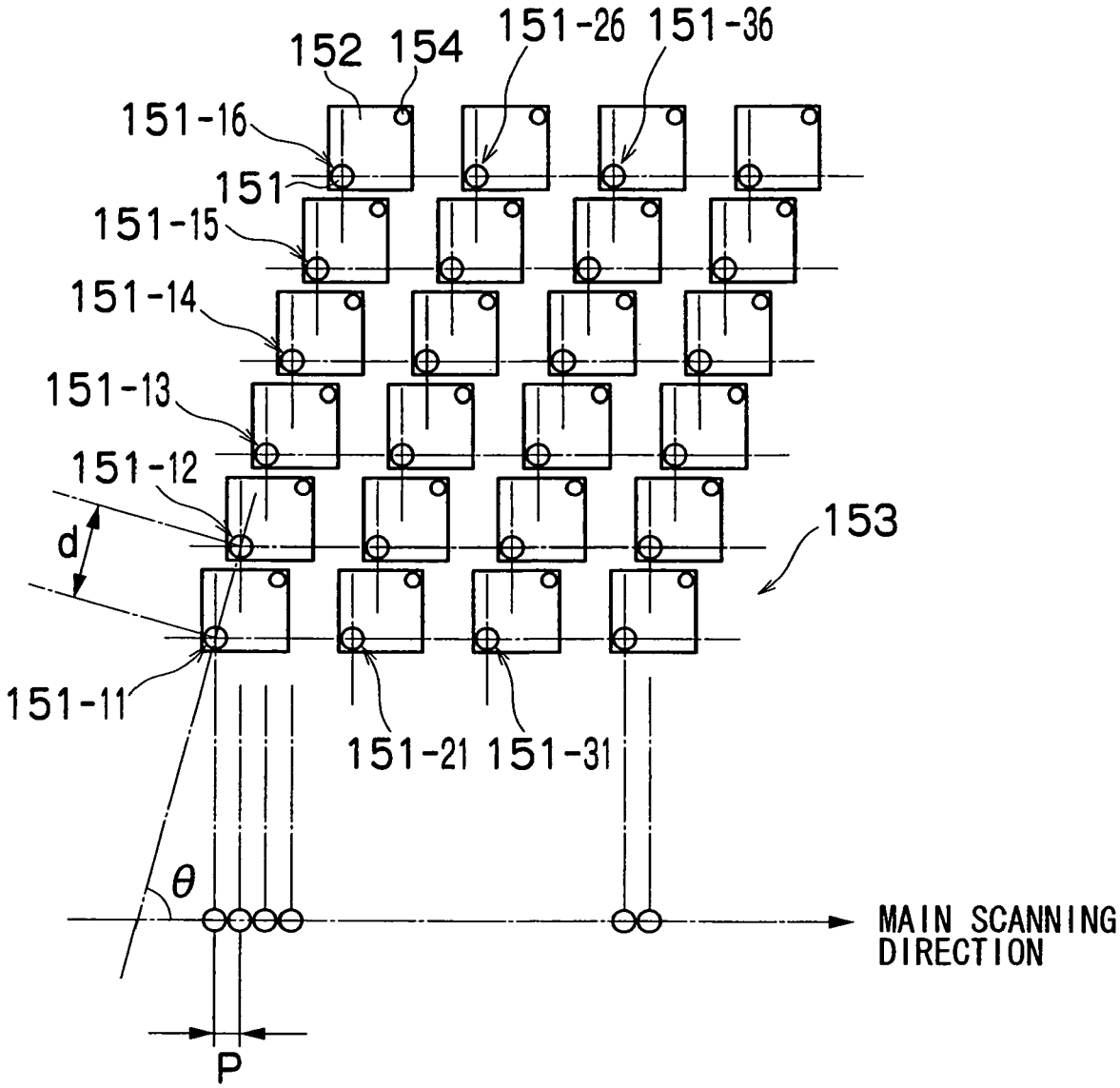
FIG. 12 is an enlarged view showing a nozzle arrangement in the print head shown in FIG. 10A.

As shown in FIG. 12, the high-density nozzle head according to the present embodiment is achieved by arranging the plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting the structure in which the plurality of ink chamber units 153 are arranged at a uniform pitch d in line with a direction forming the angle of θ with respect to the main scanning direction, the pitch P of the nozzles projected so as to align in the main scanning direction is d×cos θ, and hence the nozzles 151 can be regarded to be equivalent to those arranged linearly at the fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 12 are driven, the main scanning according to the above-described (3) is preferred. More specifically, the nozzles 151-11, 151-12, 151-13, 151-14, 151-15 and 151-16 are treated as a block (additionally; the nozzles 151-21, 151-22, . . . , 151-26 are treated as another block; the nozzles 151-31, 151-32, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is referred to as the "main scanning direction", and the direction in which sub-scanning is performed, is referred to as the "sub-scanning direction". In other words, in the present embodiment, the conveyance direction of the recording paper 116 is referred to as the sub-scanning direction and the direction perpendicular to same is referred to as the main scanning direction.

In implementing the present invention, the arrangement of the nozzles is not limited to that of the embodiment shown. Moreover, a method is employed in the present embodiment where an ink droplet is ejected by means of the deformation of the actuator 158, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 13:
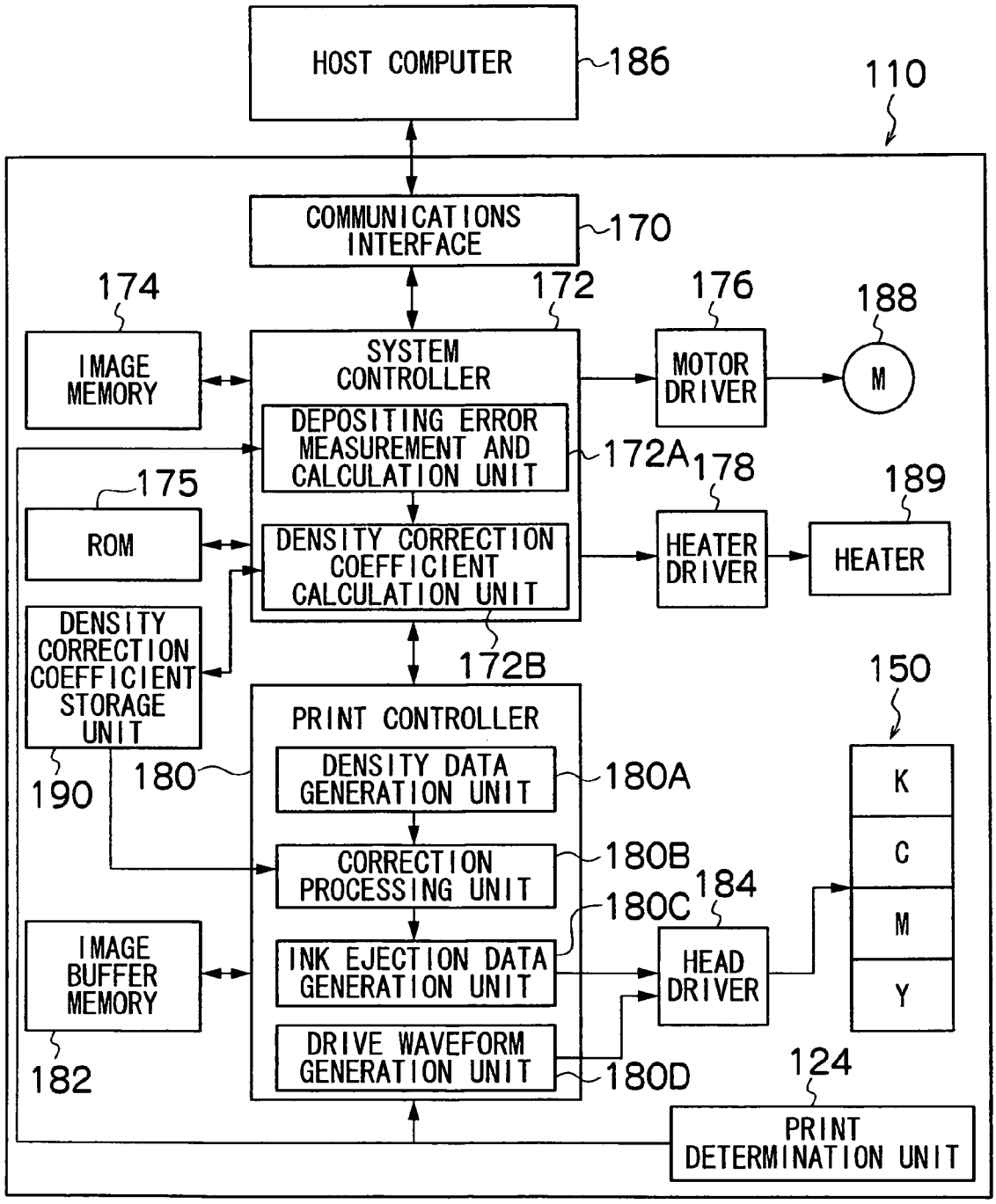
FIG. 13 is a principal block diagram showing the system configuration of the inkjet recording apparatus.

FIG. 13 is a block diagram showing the system configuration of the inkjet recording apparatus 110. The inkjet recording apparatus 110 comprises a communications interface 170, a system controller 172, an image memory 174, a ROM 175, a motor driver 176, a heater driver 178, a print controller 180, an image buffer memory 182, a head driver 184, and the like.

The communications interface 170 is an interface unit (image input device) for receiving image data sent from a host computer 186. A serial interface such as USB (Universal Serial Bus), IEEE 1394, Ethernet, and wireless network, or a parallel interface such as a Centronics interface may be used as the communications interface 170. A buffer memory (not shown) may be mounted in this portion in order to increase the communication speed.

The image data sent from the host computer 186 is received by the inkjet recording apparatus 110 through the communications interface 170, and is temporarily stored in the image memory 174. The image memory 174 is a storage device for storing images inputted through the communications interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communications interface 170, image memory 174, motor driver 176, heater driver 178, and the like, as well as controlling communications with the host computer 186 and writing and reading to and from the image memory 174 and the ROM 175, and it also generates control signals for controlling the motor 188 and heater 189 of the conveyance system.

Furthermore, the system controller 172 comprises: a depositing error measurement and calculation unit 172A which performs calculation processing for generating data of the depositing position errors, the droplet volume errors, and the ejection failures from the data read in from the test pattern by the print determination unit 124; and a density correction coefficient calculation unit 172B which calculates density correction coefficients from the information relating to the data of the depositing position errors, the droplet volume errors, and the ejection failures thus obtained. The processing functions of the depositing error measurement and calculation unit 172A and the density correction coefficient calculation unit 172B can be achieved by means of an ASIC (application specific integrated circuit), software, or a suitable combination of them.

The density correction coefficient data obtained by the density correction coefficient calculation unit 172B is stored in a density correction coefficient storage unit 190.

The program executed by the CPU of the system controller 172, the various types of data (including data of the test pattern for obtaining data of the depositing position errors, the droplet volume errors, and the ejection failures) which are required for control procedures, and the like, are stored in the ROM 175. The ROM 175 may be a non-rewriteable storage device, or it may be a rewriteable storage device, such as an EEPROM. By utilizing the storage region of this ROM 175, the ROM 175 can be configured to be able to serve also as the density correction coefficient storage unit 190.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 or the like in accordance with commands from the system controller 172.

The print controller 180 is a control unit which functions as a signal processing device for performing various treatment processes, corrections, and the like, in accordance with the control implemented by the system controller 172, in order to generate a signal for controlling droplet ejection from the image data (multiple-value input image data) in the image memory 174, and functions as a drive control device which controls the ejection driving of the head 150 by supplying the ink ejection data thus generated to the head driver 184.

In other words, the print controller 180 includes a density data generation unit 180A, a correction processing unit 180B, an ink ejection data generation unit 180C and a drive waveform generation unit 180D. These functional units (180A to 180D) can be realized by means of an ASIC, software or a suitable combination of them.

The density data generation unit 180A is a signal processing device which generates initial density data for the respective ink colors, from the input image data, and it carries out density conversion processing (including UCR processing and color conversion), and, where necessary, it also performs pixel number conversion processing.

The correction processing unit 180B in FIG. 13 is a processing device which performs density correction calculations using the density correction coefficients stored in the density correction coefficient storage unit 190, and it carries out the non-uniformity correction processing (corresponding to the non-uniformity correction processing unit 12 in FIG. 1) described above with reference to FIG. 1.

The ink ejection data generation unit 180C in FIG. 13 is a signal processing device which includes a half-toning processing device for converting the corrected density data generated by the correction processing unit 180B into binary (or multiple-value) dot data, and it performs the binary (or multiple-value) conversion processing (corresponding to the half-toning processing unit 16 in FIG. 1) described above with reference to FIG. 1. The ink ejection data generated by the ink ejection data generation unit 180C in FIG. 13 is supplied to the head driver 184, which controls the ink ejection operation of the head 150 accordingly.

The drive waveform generation unit 180D is a device for generating drive signal waveforms in order to drive the actuators 158 (see FIG. 11) corresponding to the respective nozzles 151 of the head 150. The signals (drive waveforms) generated by the drive waveform generation unit 180D is applied to the head driver 184. The signals outputted from the drive signal generation unit 180D may be digital waveform data, or it may be an analog voltage signals.

The image buffer memory 182 is provided with the print controller 180, and image data, parameters, and other data are temporarily stored in the image buffer memory 182 when image data is processed in the print controller 180. FIG. 13 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is inputted from an external source through the communications interface 170, and is accumulated in the image memory 174. At this stage, multiple-value RGB image data is stored in the image memory 174, for example.

In this inkjet recording apparatus 110, an image which appears to have a continuous tonal graduation to the human eye is formed by changing the deposition density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180, through the system controller 172, and is converted to the dot data for each ink color by a half-toning technique, using dithering, error diffusion, or the like, by way of the density data generation unit 180A, the correction processing unit 180B, and the ink ejection data generation unit 180C of the print controller 180.

In other words, the print controller 180 performs processing for converting the input RGB image data into dot data for the four colors of K, C, M and Y. The dot data thus generated by the print controller 180 is stored in the image buffer memory 182. This dot data of the respective colors is converted into CMYK droplet ejection data for ejecting ink from the nozzles of the head 150, thereby establishing the ink ejection data to be printed.

The head driver 184 outputs drive signals for driving the actuators 158 corresponding to the nozzles 151 of the head 150 in accordance with the print contents, on the basis of the ink ejection data and the drive waveform signals supplied by the print controller 180. A feedback control system for maintaining constant drive conditions in the head may be included in the head driver 184.

By supplying the drive signals outputted by the head driver 184 to the head 150 in this way, ink is ejected from the corresponding nozzles 151. By controlling ink ejection from the print head 150 in synchronization with the conveyance speed of the recording paper 116, an image is formed on the recording paper 116.

As described above, the ejection volume and the ejection timing of the ink droplets from the respective nozzles are controlled through the head driver 184, on the basis of the ink ejection data and the drive signal waveforms generated by implementing prescribed signal processing in the print controller 180. By this means, prescribed dot sizes and dot positions can be achieved.

As described with reference to FIG. 8, the print determination unit 124 is a block including an image sensor which reads in the image printed on the recording medium 116, performs various signal processing operations, and the like, and determines the print situation (presence/absence of ejection, variation in droplet ejection, optical density, and the like), these determination results being supplied to the print controller 180 and the system controller 172.

The print controller 180 implements various corrections with respect to the head 150, on the basis of the information obtained from the print determination unit 124, according to requirements, and it implements control for carrying out cleaning operations (nozzle restoring operations), such as preliminary ejection, suctioning, or wiping, as and when necessary. In other words, the print controller 180 functions as a selection device which selects one from correction coefficient generation methods A to C described above with reference to FIG. 4, and also functions as a control device which implements head cleaning when it is judged that it is not possible to carry out the correction.

In the case of the present embodiment, the combination of the print determination unit 124 and the depositing error measurement calculation unit 172A corresponds to the "characteristic information acquisition device", and the density correction coefficient calculation unit 172B corresponds to the "correction range setting device" and the "correction coefficient specification device". Furthermore, the correction processing unit 180B corresponds to the "correction processing device".

According to the inkjet recording apparatus 110 having the foregoing composition, it is possible to obtain a satisfactory image in which density non-uniformity is reduced.

Second Embodiment

Application to Shuttle Head

The present invention is not limited to application to a line head printer, and by applying the correction technology according to the present invention to a shuttle scanning type of printer, it is possible to improve the image quality, and as a result, to reduce the number of passes and increase the printing speed.

Figure 14:
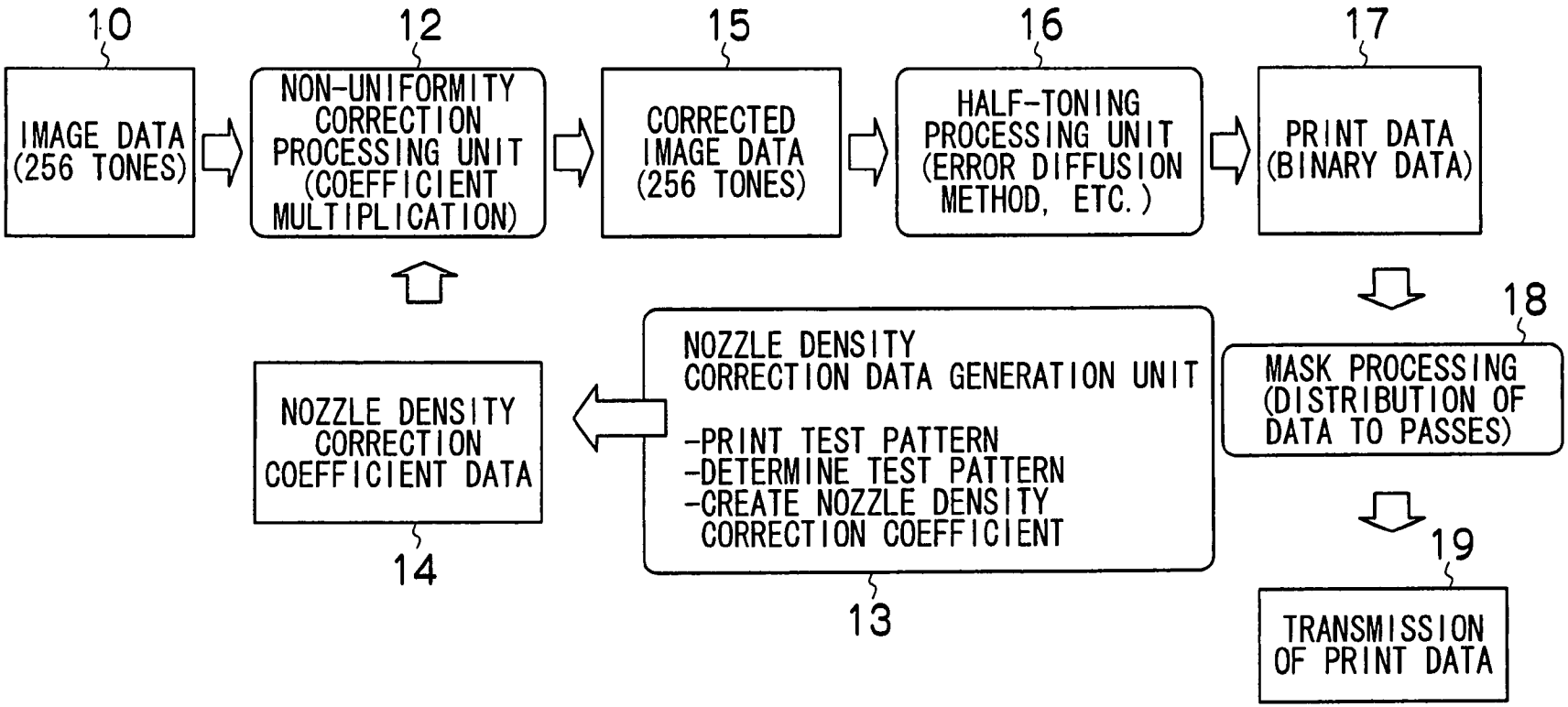
FIG. 14 is a flow diagram showing the sequence of image processing according to another embodiment of the present invention.

FIG. 14 is an image processing flow diagram in the case of a shuttle scanning system. In FIG. 14, elements which are the same or similar to those in FIG. 1 are labeled with the same reference numerals and description thereof is omitted here. The shuttle scanning system shown in FIG. 14 differs from the line head composition shown in FIG. 1 in that: after obtaining the print data (binary data) denoted with the reference numeral 17, the data is distributed into each pass by the mask processing unit 18, and this masked data is then sent from the print data transmission unit 19 to the print head.

Moreover, in the non-uniformity correction processing unit 12 shown in FIG. 14, with respect to each pixel, the density correction coefficient of a nozzle that is to carry out printing is referenced, and multiplication of the coefficient is carried out. The process for generating correction coefficients in the nozzle density correction coefficient data generation unit 13 is similar to that of the first embodiment described with reference to FIG. 1.

In the mask processing unit 18 shown in FIG. 14, the image data is distributed into a plurality of passes by using a plurality of mutually complementary masks. For example, in the case of a head having 512 nozzle rows (1200 npi), if the print resolution is 1200 dpi×1200 dpi, and the number of passes is set to N_pass=4, then the mask processing unit 18 distributes the print data into four passes by means of four mutually complementary masks. The number of passes can be changed in accordance with the image quality mode. The number of masks is determined in accordance with the set number of passes.

Figure 15:
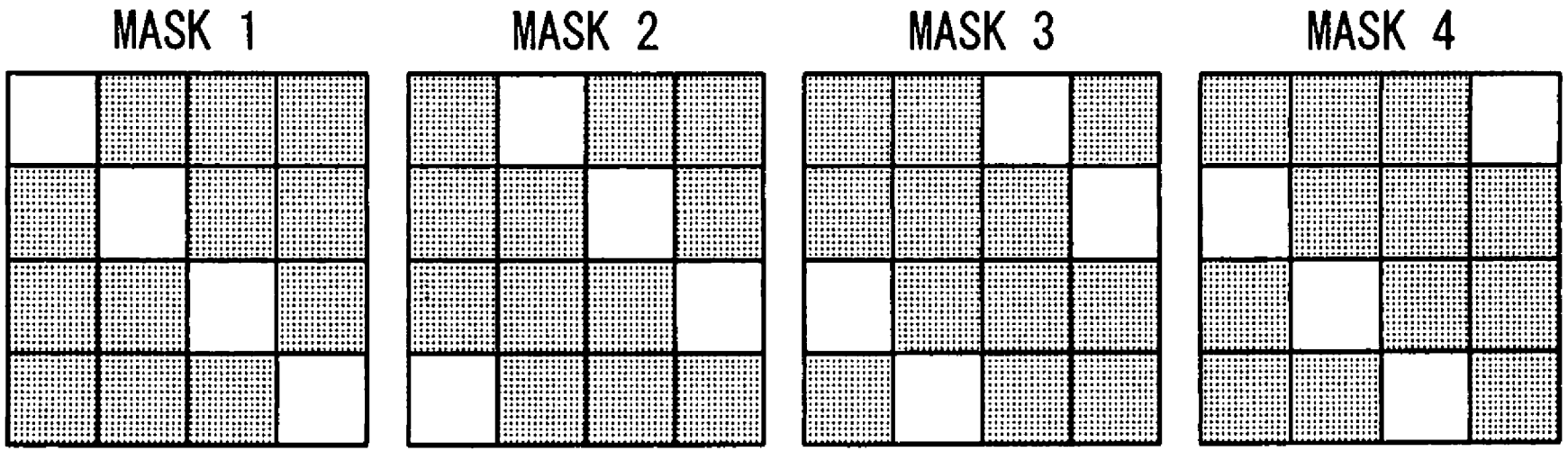
FIG. 15 is an illustrative diagram showing an embodiment of data distribution processing using masks.

FIG. 15 is a schematic conceptual diagram showing an embodiment of data distribution processing by means of masks. The four types of masks 1 to 4 shown in FIG. 15 have relationships in which the unmasked regions (white portions) do not overlap among the masks and the superimposed set of data that is distributed by the masks 1 to 4 (i.e., the collective data) corresponds with the original data (in other words, the masks have a mutually complementary relationship).

Figure 16:
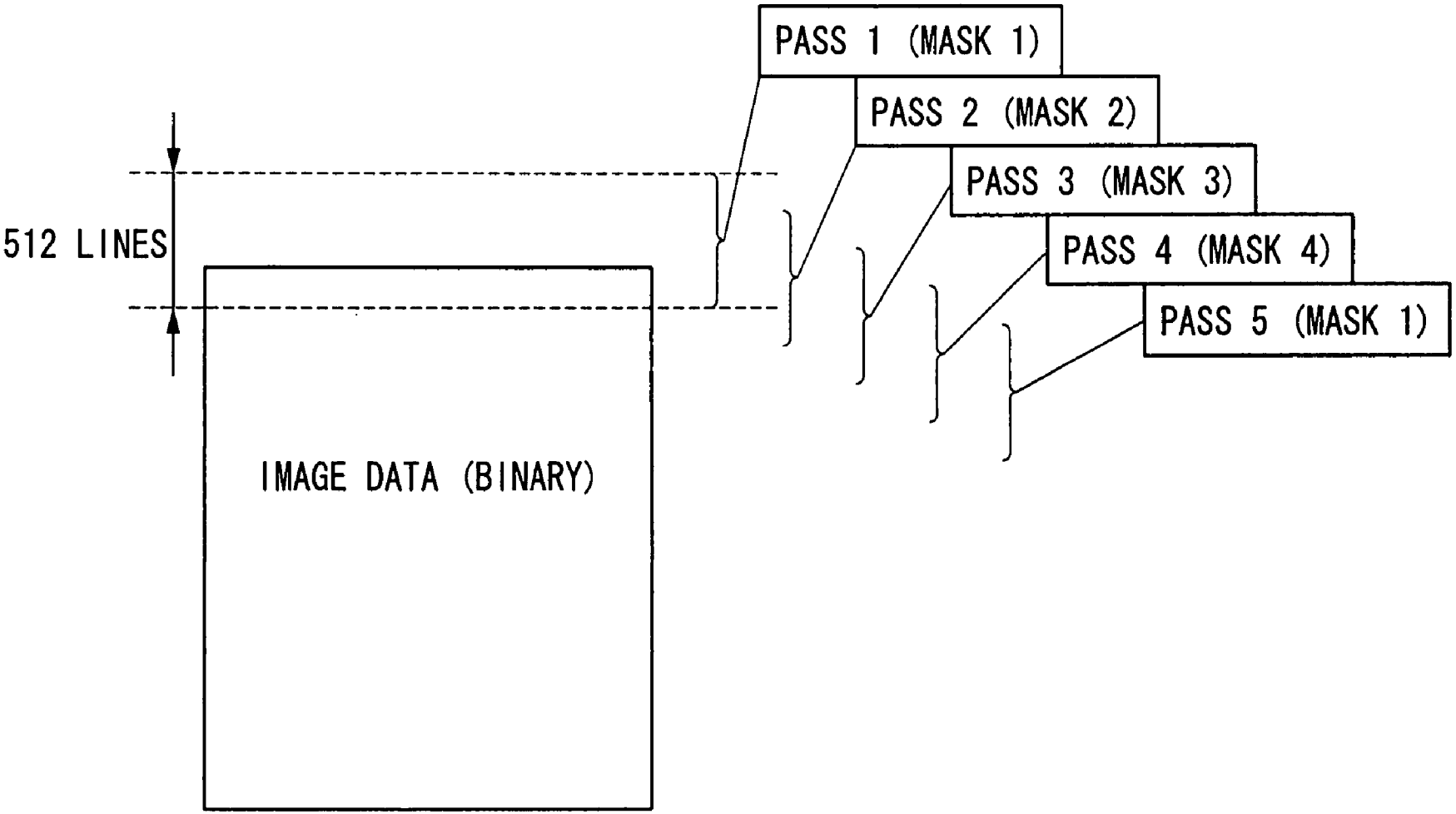
FIG. 16 is an illustrative diagram showing an embodiment of processing for transmitting print data to a head.
Figure 17:
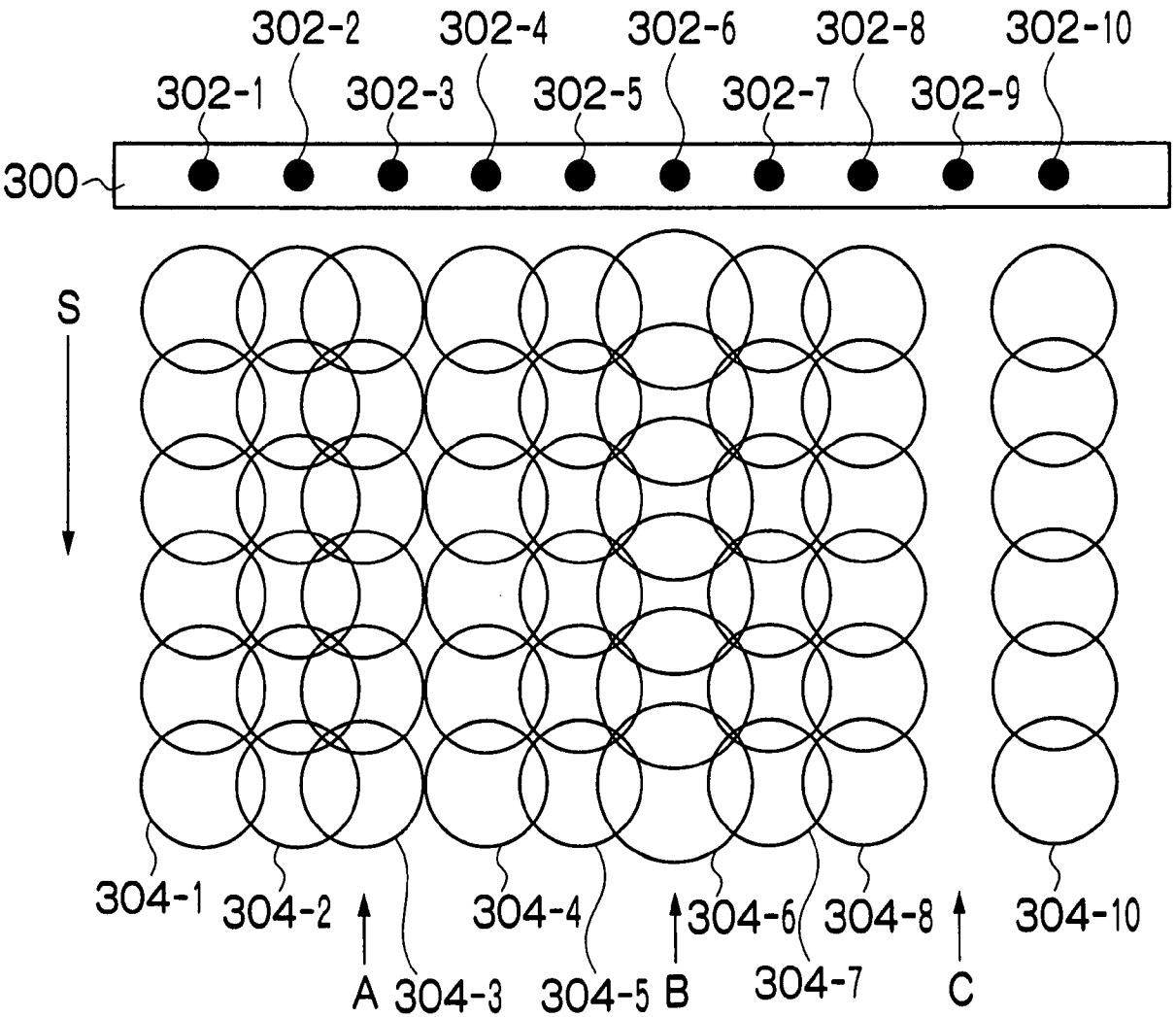
FIG. 17 is a schematic drawing for describing the relationship between variation in the ejection characteristics of the nozzles, and density non-uniformity.
Figure 18:
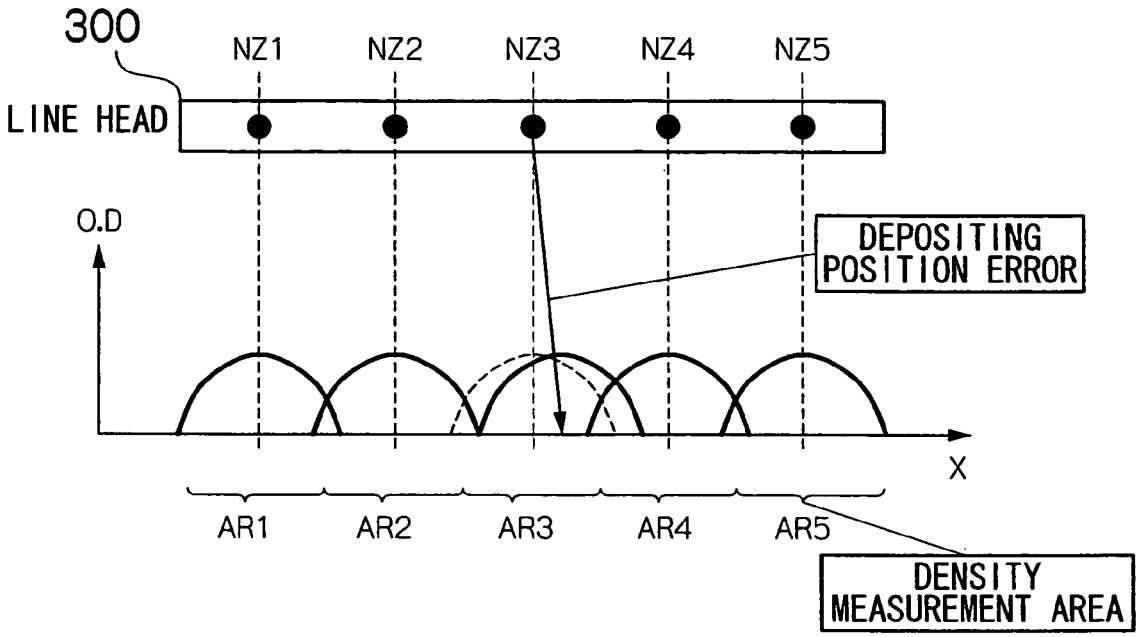
FIG. 18 is an illustrative diagram of a correction method in the related art.
Figure 19:
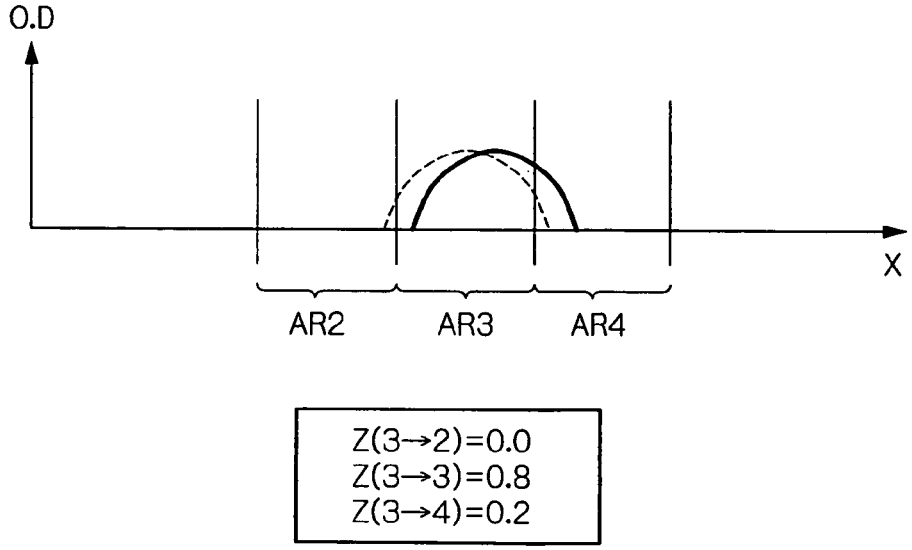
FIG. 19 is an illustrative diagram showing an example of the specification of weightings according to a correction method in the related art.

FIG. 16 is a conceptual diagram of a transmission process for print data that has been distributed by the masks 1 to 4. As shown in FIG. 16, the masked image data is sent to the print head and band-shaped printing corresponding to one pass is carried out accordingly, for each scan (one pass) of the head in the main scanning direction. In other words, pass 1 printing is carried out on the basis of the image data processed by the mask 1, and pass 2 printing is carried out on the basis of the image data processed by the mask 2. Thereafter, similarly, pass 3 printing is carried out on the basis of the image data processed by the mask 3, and pass 4 printing is carried out on the basis of the image data processed by the mask 4. A similar process is repeated along with the conveyance of the recording medium (movement of the recording medium in the sub-scanning direction), and accordingly pass 5 printing is carried out on the basis of image data processing by the mask 1.

MODIFICATION EXAMPLE

It is also possible to adopt a mode in which all or a portion of the functions carried out by the depositing error measurement calculation unit 172A, the density correction coefficient calculation unit 172B, the density data generation unit 180A, and the correction processing unit 1 80B, which are described in FIG. 14, are installed in the host computer 186.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a recording head which has a plurality of recording elements;

a conveyance device which causes the recording head and a recording medium to move relatively to each other by conveying at least one of the recording head and the recording medium;

a characteristic information acquisition device which acquires information that indicates recording characteristics of the recording elements, the recording characteristics including recording position errors of the recording elements and errors in volume of droplets ejected from the recording elements;

a correction range setting device which sets N correction recording elements (where N is an integer larger than 1) for use in correction of output density, from among the plurality of recording elements;

a correction coefficient specification device which specifies density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero;

a correction processing device which performs calculation for correcting the output density by using the density correction coefficients specified by the correction coefficient specification device; and a drive control device which controls driving of the recording elements according to correction results produced by the correction processing device.

2. The image recording apparatus as defined in claim 1, wherein the density correction coefficients for the recording elements are specified by the following equation:

$$d_i = \begin{cases} \dfrac{1}{1+\Delta v_i} \cdot \dfrac{\prod_k x_k}{x_i \cdot \prod_{k \neq i} (x_k - x_i)} - 1 \\ \left(\begin{array}{l}\text{for a correction object recording} \\ \text{element of the recording elements}\end{array}\right) \\ \dfrac{1}{1+\Delta v_i} \cdot \dfrac{\prod_k x_k}{x_i \cdot \prod_{k \neq i} (x_k - x_i)} \\ \left(\begin{array}{l}\text{for a recording element of the recording elements,} \\ \text{other than the correction object recording element}\end{array}\right) \end{cases}$$

where i indicates a recording element of the recording elements and serves as an index identifying a position of the recording element i, $d_i$ is the density correction coefficient for the recording element i, $x_i$ is a recording position of the recording element i, $V_i$ is the volume of the droplet ejected from the recording element i, and $V_0$ is an ideal volume of the droplets ejected from the recording elements, and $\Delta v_i$ is the error in the volume of the droplet ejected from the recording element i defined as $$\Delta v_i = \frac{V_i}{V_0} - 1.$$

3. The image recording apparatus as defined in claim 1, wherein:

i and k respectively indicate recording elements i and k of the recording elements and serve as indexes identifying the recording elements i and k;

in relation to the recording position error of the recording element k, the density correction coefficients are specified for the N recording elements including the recording element k and a surrounding recording element which is located in a vicinity of the recording element k;

d(i, k) is the density correction coefficient for the recording element i with respect to the recording position error of the recording element k; and a total density correction coefficient $d_i$ for the recording element i is obtained by linear combination of d(i, k) which are acquired by varying the k.

4. An image recording apparatus, comprising:

a recording head which has a plurality of recording elements;

a conveyance device which causes the recording head and a recording medium to move relatively to each other by conveying at least one of the recording head and the recording medium;

a characteristic information acquisition device which acquires information that indicates recording characteristics of the recording elements, the recording characteristics including recording position errors of the recording elements and ejection failures of the recording elements;

a correction range setting device which sets N correction recording elements (where N is an integer larger than 1) for use in correction of output density, from among the plurality of recording elements;

a correction coefficient specification device which specifies density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero;

a correction processing device which performs calculation for correcting the output density by using the density correction coefficients specified by the correction coefficient specification device; and a drive control device which controls driving of the recording elements according to correction results produced by the correction processing device.

5. The image recording apparatus as defined in claim 4, wherein the density correction coefficients for the recording elements are specified by the following equation:

$$d_i = \begin{cases} -1 \left(\begin{array}{l}\text{for a correction object recording} \\ \text{element of the recording elements}\end{array}\right) \\ \dfrac{-1}{1+\Delta v_i} \cdot \dfrac{\prod_k x_k}{x_i \cdot \prod_{k \neq i} (x_k - x_i)} \\ \left(\begin{array}{l}\text{for a recording element of the recording elements,} \\ \text{other than the correction object recording element}\end{array}\right) \end{cases}$$

where i indicates a recording element of the recording elements and serves as an index identifying a position of the recording element i, $d_i$ is the density correction coefficient for the recording element i, $x_i$ is a recording position of the recording element i, $V_i$ is volume of a droplet ejected from the recording element i, and $V_0$ is an ideal volume of droplets ejected from the recording elements, and $\Delta v_i$ is an error in the volume of the droplet ejected from the recording element i defined as $$\Delta v_i = \frac{V_i}{V_0} - 1.$$

6. The image recording apparatus as defined in claim 4, wherein, if a surrounding recording element to be used in the correction of a correction object recording element of the recording elements suffers the ejection failure, the correction range setting device alters setting of the recording elements that are used in the correction in such a manner that the surrounding recording element suffering the ejection failure is not used in the correction.

7. The image recording apparatus as defined in claim 4, wherein, of the recording elements, a deteriorated recording element from which volume of a droplet ejected is not greater than 50% of a reference value is treated as a defective recording element suffering the ejection failure.

8. The image recording apparatus as defined in claim 4, wherein:

i and k respectively indicate recording elements i and k of the recording elements and serve as indexes identifying the recording elements i and k;

in relation to the recording position error of the recording element k, the density correction coefficients are specified for the N recording elements including the recording element k and a surrounding recording element which is located in a vicinity of the recording element k;

d(i, k) is the density correction coefficient for the recording element i with respect to the recording position error of the recording element k; and a total density correction coefficient $d_i$ for the recording element i is obtained by linear combination of d(i, k) which are acquired by varying the k.

9. An image recording method for recording an image on a recording medium by a plurality of recording elements of a recording head while causing the recording head and the recording medium to move relatively to each other by conveying at least one of the recording head and the recording medium, the image recording method including the steps of:

acquiring information that indicates recording characteristics of the recording elements, the recording characteristics including recording position errors of the recording elements and errors in volume of droplets ejected from the recording elements;

setting N correction recording elements (where N is an integer larger than 1) for use in correction of output density, from among the plurality of recording elements;

specifying density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero;

performing calculation for correcting the output density by using the specified density correction coefficients; and controlling driving of the recording elements according to correction results produced from the calculation for correcting the output density.

10. An image recording method for recording an image on a recording medium by a plurality of recording elements of a recording head while causing the recording head and the recording medium to move relatively to each other by conveying at least one of the recording head and the recording medium, the image recording method including the steps of:

acquiring information that indicates recording characteristics of the recording elements, the recording characteristics including recording position errors of the recording elements and ejection failures of the recording elements;

setting N correction recording elements (where N is an integer larger than 1) for use in correction of output density, from among the plurality of recording elements;

specifying density correction coefficients for the N correction recording elements according to correction conditions including conditions where a differential coefficient at a frequency origin point (f=0) in a power spectrum representing spatial frequency characteristics of a density non-uniformity caused by the recording characteristics of at least one of the recording elements becomes substantially zero;

performing calculation for correcting the output density by using the specified density correction coefficients; and controlling driving of the recording elements according to correction results produced from the calculation for correcting the output density.

* * * * *